US010222731B2

(12) United States Patent
Obata et al.

(10) Patent No.: US 10,222,731 B2
(45) **Date of Patent: *Mar. 5, 2019**

(54) FIXING DEVICE HAVING A CYLINDRICAL ROTATABLE HEATING MEMBER THAT INCLUDES A HOLE AND A SLIT AT A LONGITUDINAL END PORTION

(71) Applicant: CANON KABUSHIKI KAISHA, Tokyo (JP)

(72) Inventors: Seiji Obata, Mishima (JP); Yuki Nishizawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/358,849

(22) Filed: Nov. 22, 2016

(65) Prior Publication Data

US 2017/0146935 A1 May 25, 2017

(30) Foreign Application Priority Data

Nov. 24, 2015 (JP) ..... 2015-228559

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
See application file for complete search history.

(56) References Cited

U.S. PATENT DOCUMENTS

| | | | |
|---|---|---|---|
| 7,369,806 | B2 | 5/2008 | Tomatsu et al. |
| 8,843,046 | B2 | 9/2014 | Nawa et al. |
| 9,377,733 | B2 | 6/2016 | Nishizawa et al. |
| 2017/0160682 | A1* | 6/2017 | Nishizawa ..... G03G 15/206 |

FOREIGN PATENT DOCUMENTS

| | | | |
|---|---|---|---|
| JP | 10-198210 | A | 7/1998 |
| JP | 2000081806 | A | 3/2000 |
| JP | 2003330291 | A | 11/2003 |
| JP | 2006-039433 | A | 2/2006 |
| JP | 2011-197673 | A | 10/2011 |
| JP | 2013-087810 | A | 5/2013 |
| JP | 2014026267 | A | 2/2014 |

OTHER PUBLICATIONS

Co-pending U.S. Appl. No. 15/371,837, filed Dec. 7, 2016.

* cited by examiner

*Primary Examiner* — David M. Gray
*Assistant Examiner* — Michael A Harrison
(74) *Attorney, Agent, or Firm* — Venable LLP

(57) ABSTRACT

A fixing device for fixing an image on a recording material includes a cylindrical rotatable heater that is provided with a hole portion at least at a longitudinal end portion, and a driving member engaged with the longitudinal end portion of the heater to rotate the heater. The driving member is provided with a claw portion engaged with the hole portion of the heater. The image is fixed on the recording material by the heat from the heater. In addition, the heater is provided, at the other longitudinal end portion, with a slit extending toward a central portion, the slit being disposed at a position different from the hole portion with respect to a circumferential direction of the heater so as to overlap the hole portion in the longitudinal direction.

15 Claims, 13 Drawing Sheets

(a)

(b)

FIXING DEVICE HAVING A CYLINDRICAL ROTATABLE HEATING MEMBER THAT INCLUDES A HOLE AND A SLIT AT A LONGITUDINAL END PORTION

This application claims the benefit of Japanese Patent Application No. 2015-228559 filed on Nov. 24, 2015, which is hereby incorporated by reference herein in its entirety.

FIELD OF INVENTION AND RELATED ART

The present invention relates to a fixing device that is to be mounted in an image forming apparatus, such as an electrophotographic copying machine, an electrophotographic printer, and the like, to fix an image to a sheet of recording medium.

Generally speaking, a fixing device that is to be mounted in an image forming apparatus, such as a copying machine and a printing machine, has a fixation roller that rotates while being heated, and a pressure roller that is kept pressed upon the fixation roller with the application of a preset amount of pressure. A fixing device fixes a toner image, formed on a sheet of recording medium (i.e., a sheet), to the sheet by heating the sheet and the toner image, while conveying the sheet through a nip formed between the fixation roller and the pressure roller.

There have been known fixing devices that have a fixation roller made up of a piece of tube having a thin wall, and are structured so that a driving gear is attached to one end of the fixation roller to transmit a driving force from a driving force source to the fixation roller by way of the driving gear, like the one disclosed in Japanese Patent Document No 2013-87810. In these fixing devices, one of the lengthwise end portions of the fixation roller is provided with slots (also referred to as slits), whereas the driving gear is provided with pawls. These fixing devices are structured so that the pawls of the driving gear fit into the slots, one for one. This structural arrangement, however, suffers from the following problem. That is, as the driving force is transmitted to the fixation roller through the area of engagement between each pawl of the driving gear and the edge of the corresponding slot of the fixation roller, the edge of each slot is subjected to such stress that works in a direction to widen the slot. Thus, if the amount of load to which the edge of each slot is subjected is substantial, it is possible that the lengthwise end portion of the fixation roller will be deformed in a manner to widen the slot. Therefore, if the fixation roller is further reduced in the thickness of its wall, it is possible that the fixation roller will be damaged, and it is possible that the pawl of the driving gear will bend the edge portion of the slot outward in terms of the radius direction of the fixation roller.

SUMMARY OF THE INVENTION

According to one aspect, the present invention provides a fixing device for fixing an image on a recording material, the fixing device comprising a cylindrical rotatable heating member that is provided with a hole portion at least at a longitudinal end portion, and a driving member engaged with the longitudinal end portion of the rotatable heating member to rotate the rotatable heating member, the driving member being provided with a claw portion engaged with the hole portion of the rotatable heating member, wherein the image is fixed on the recording material by the heat from the rotatable heating member, and wherein the rotatable heating member is provided, at the other longitudinal end portion, with a slit extending toward a central portion, the slit being disposed at a position different from the hole portion with respect to a circumferential direction of the rotatable heating member so as to overlap the hole portion in the longitudinal direction of the rotatable heating member.

Further features of the present invention will become apparent from the following description of exemplary embodiments, with reference to the attached drawings.

BRIEF DESCRIPTION OF THE DRAWINGS

Part (a) of FIG. 1 is an exploded perspective view of one of lengthwise end portions of a fixation roller, from which the fixation roller is driven, and shows one of the lengthwise end portions of the fixation roller and a driving gear fitted around the lengthwise end portion of the fixation roller.

Part (b) of FIG. 1 is an exploded perspective view of another lengthwise end portion of the fixation roller, that is, the lengthwise end portion from which the fixation roller is not driven, and shows the other lengthwise end portion and a fixation roller cap.

Figure 3:
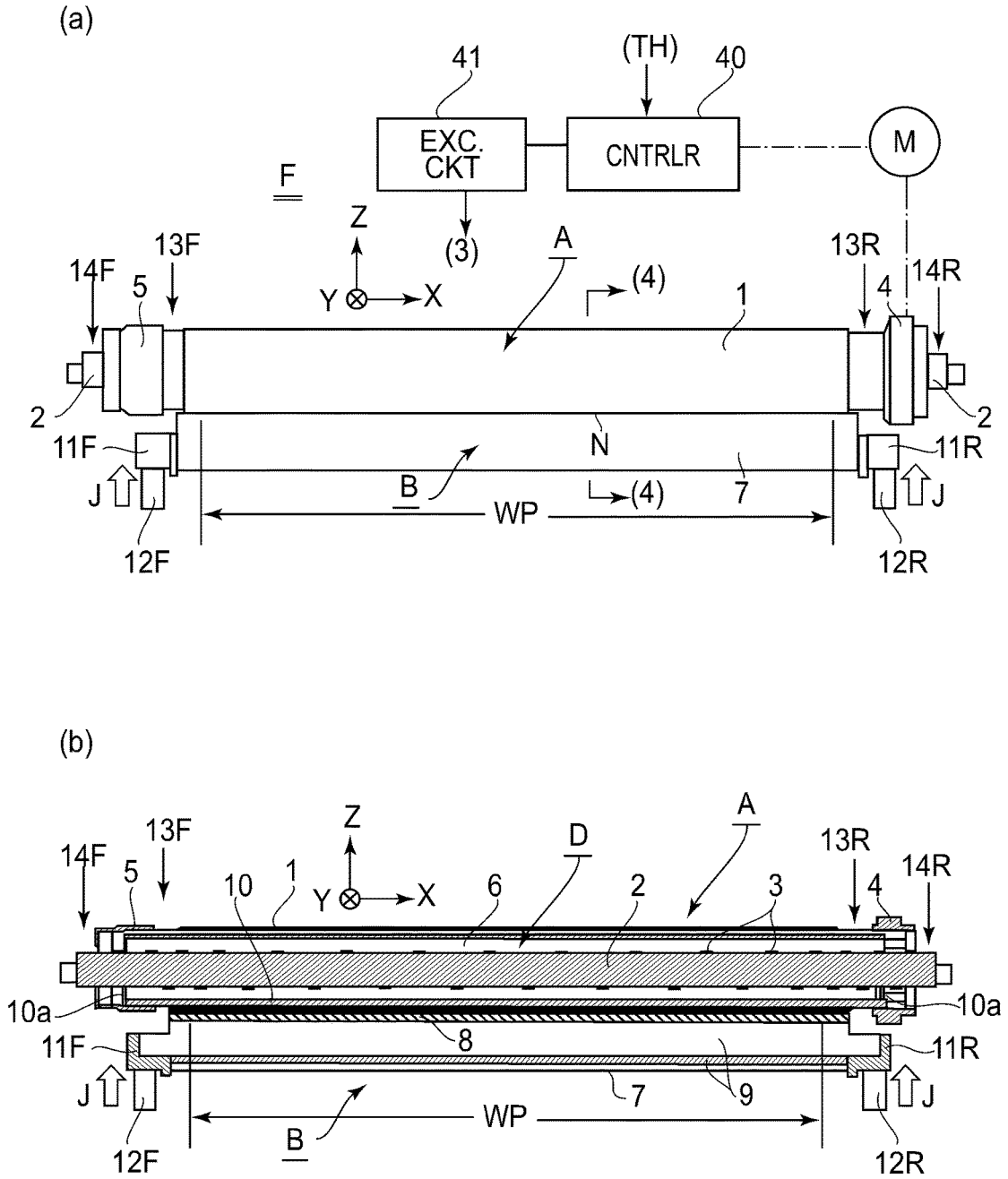

Part (a) of FIG. 3 is a schematic front view of an essential portion of a fixing device in one of the preferred embodiments of the present invention, and part (b) of FIG. 3 is a vertical sectional view of the same portion as the one shown in part (a) of FIG. 3.

Figure 4:
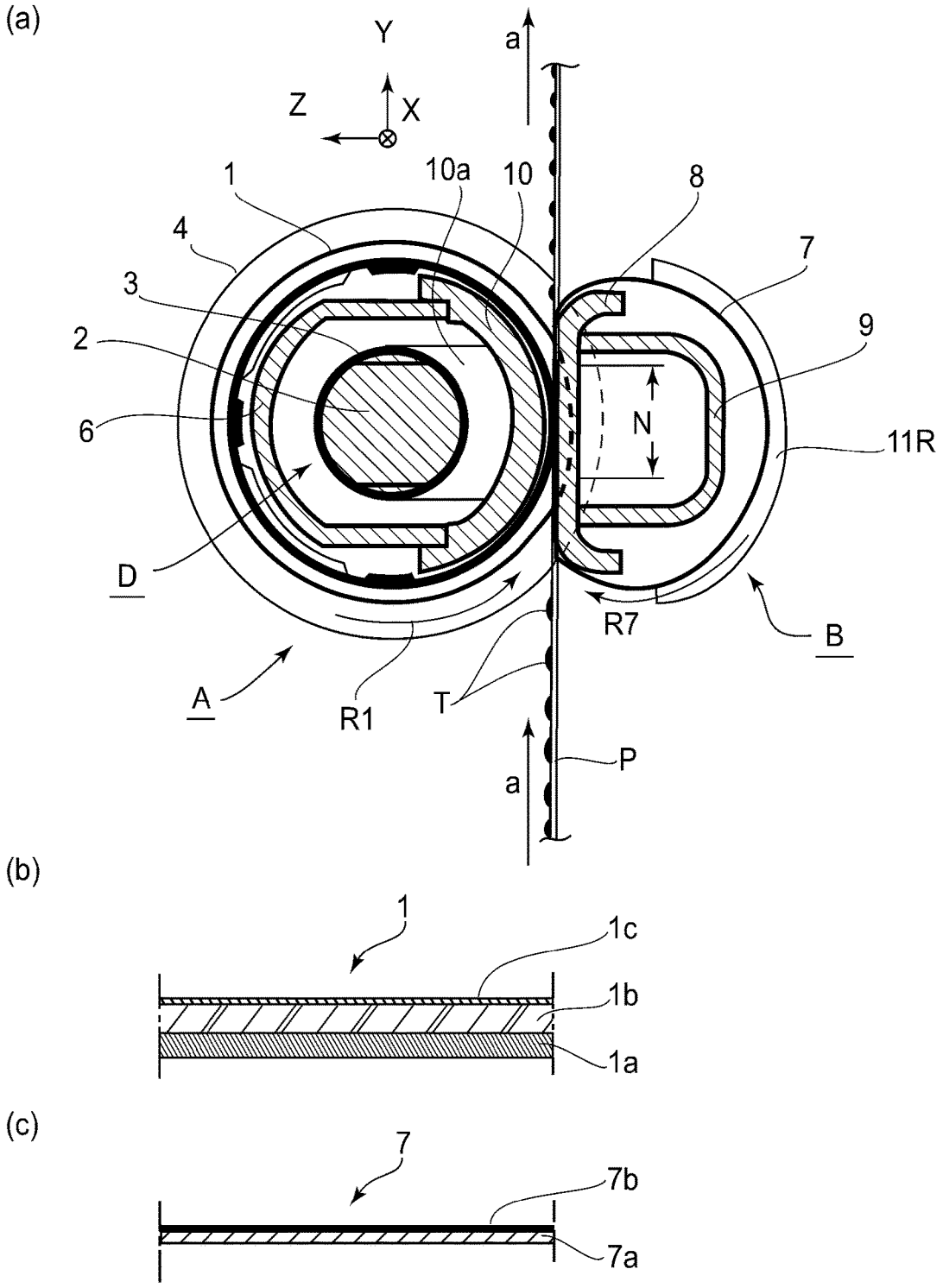

Part (a) of FIG. 4 is an enlarged schematic sectional view of the essential portion of the fixing device at a vertical plane, which is indicated by a pair of arrow marks (4) and (4) in part (a) of FIG. 3, and is perpendicular to the lengthwise direction of the fixation roller.

Part (b) of FIG. 4 is a sectional view of a part of the fixation roller at a plane that coincides with an axial line of the fixation roller and shows a laminar structure of the fixation roller. Part (c) of FIG. 4 is a sectional view of a pressure belt, at a plane that is perpendicular to the belt and shows a laminar structure of the belt.

Figure 5:
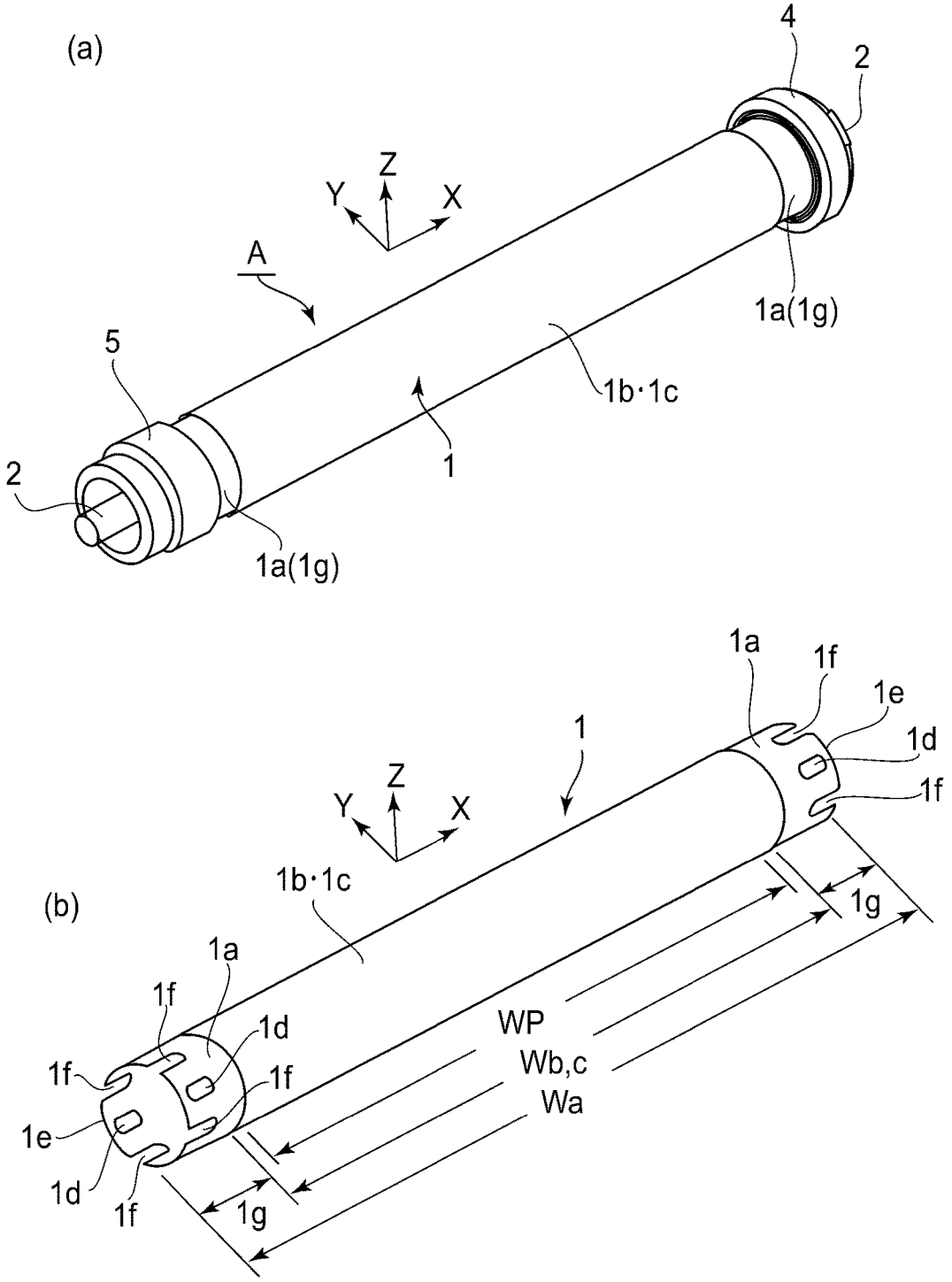

Part (a) of FIG. 5 is an external perspective view of a heating unit of the fixing device, and part (b) of FIG. 5 is an external perspective view of the fixation roller.

Figure 6:
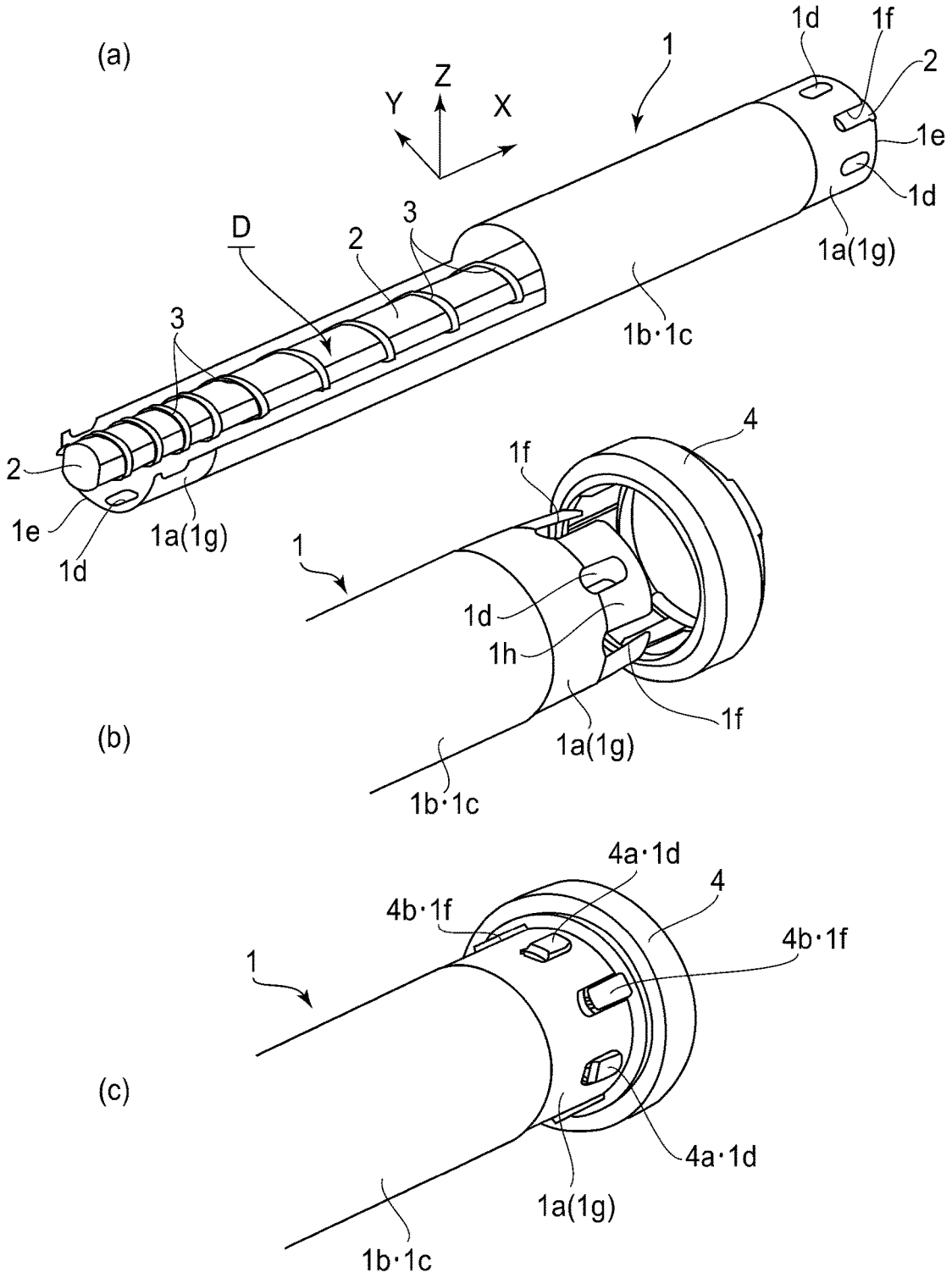

Part (a) of FIG. 6 is a perspective cutaway view of the fixation roller of the fixing device and shows an induction heating (IH) heater, which is provided in a hollow of the fixation roller.

Part (b) of FIG. 6 is a drawing for describing a procedure to attach the driving gear to the fixation roller.

Part (c) of FIG. 6 is a perspective view of the lengthwise end portion of the fixation roller after the attachment of the driving gear thereto.

Figure 7:
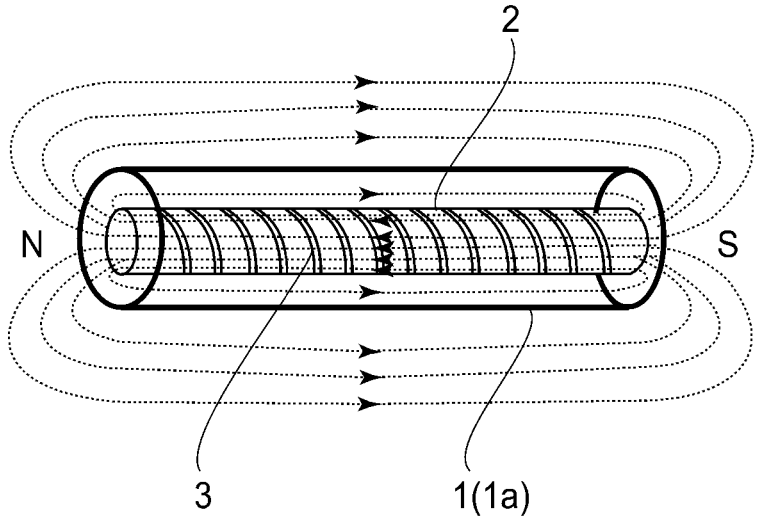
Figure 7:
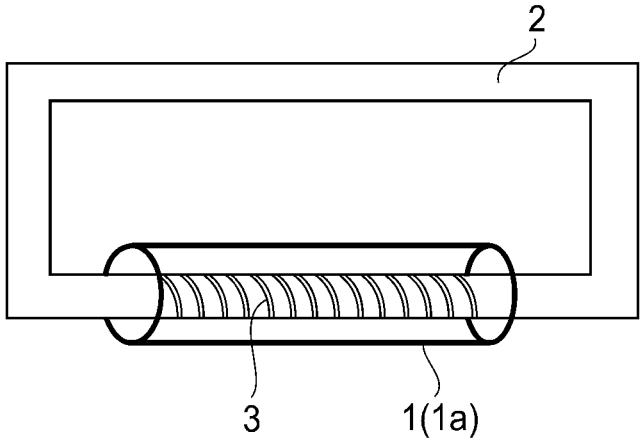

Part (a) of FIG. 7 is a drawing of a combination of a heating device based on electromagnetic induction, and the magnetic field that the heating device generates, and shows the direction of magnetic fluxes. Part (b) of FIG. 7 is a drawing of a heating device based on electromagnetic induction when a core forms a loop.

Figure 8:
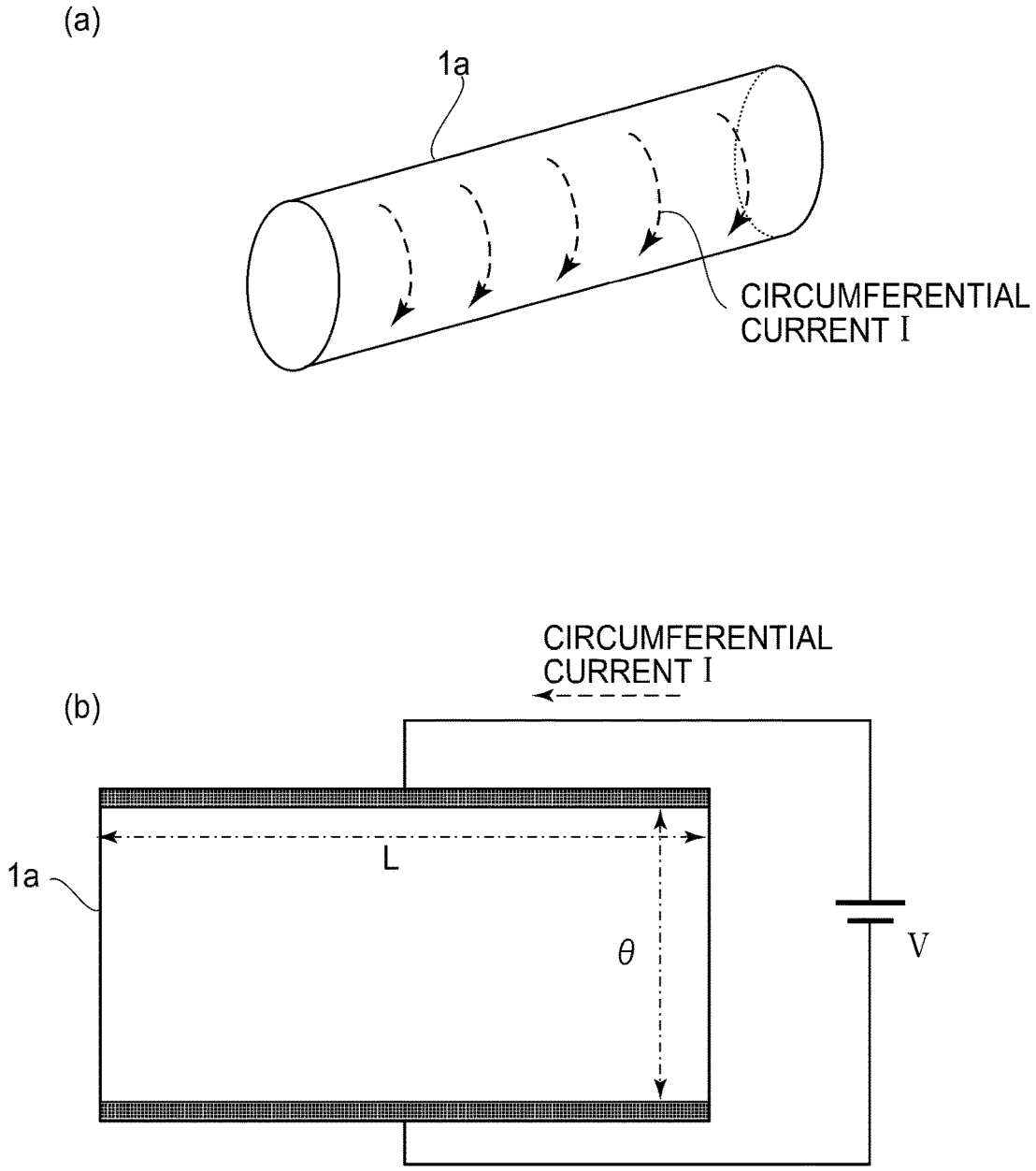

Parts (a) and (b) of FIG. 8 are schematic drawings for describing the electric current that flows through an electrically conductive layer of a slot-less fixation roller, in the circumferential direction of the roller.

Figure 9:
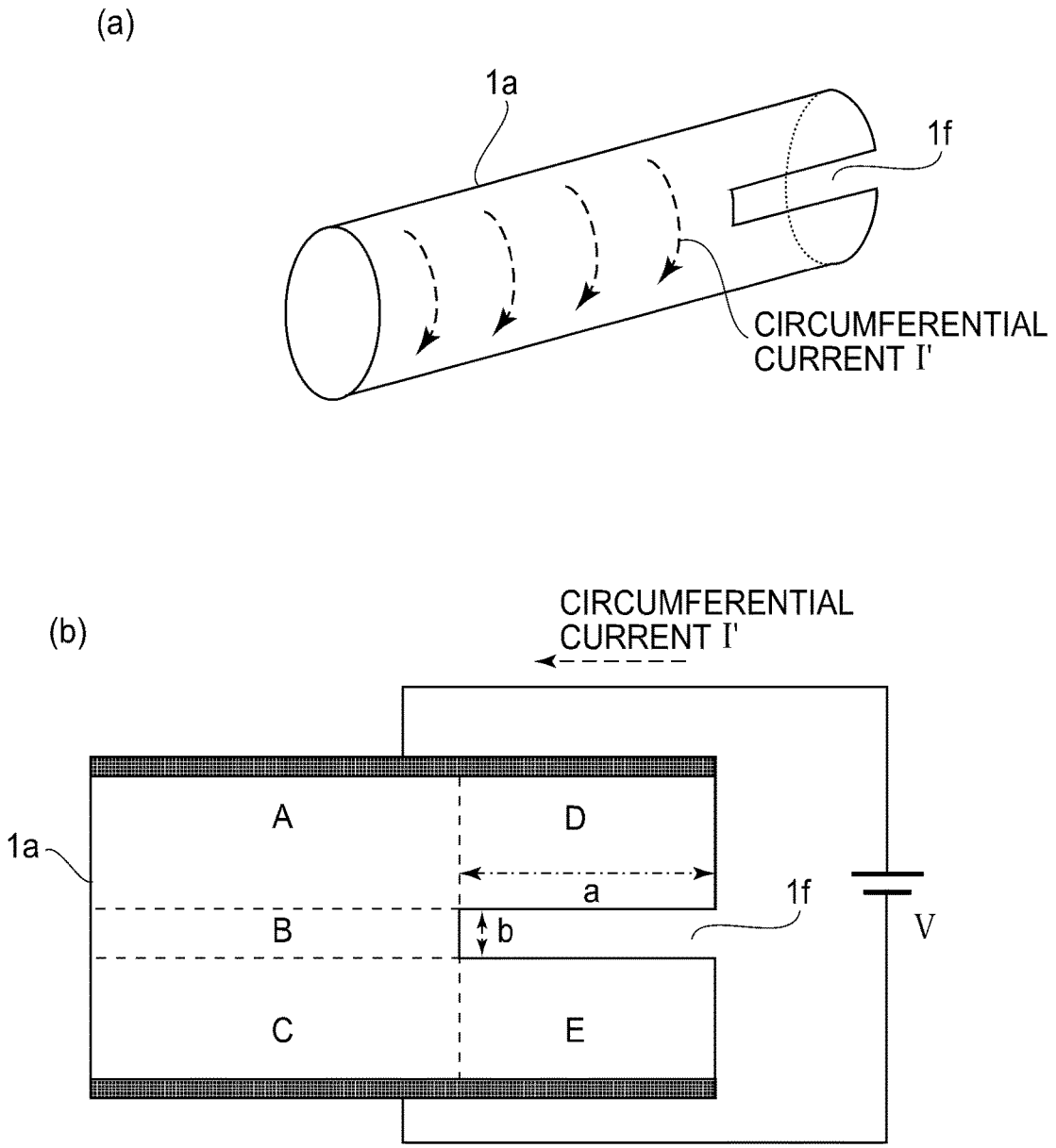

Parts (a) and (b) of FIG. 9 are schematic drawings for describing the electric current that flows through the electrically conductive layer of a slotted fixation roller, in the circumferential direction of the fixation roller.

Figure 10:
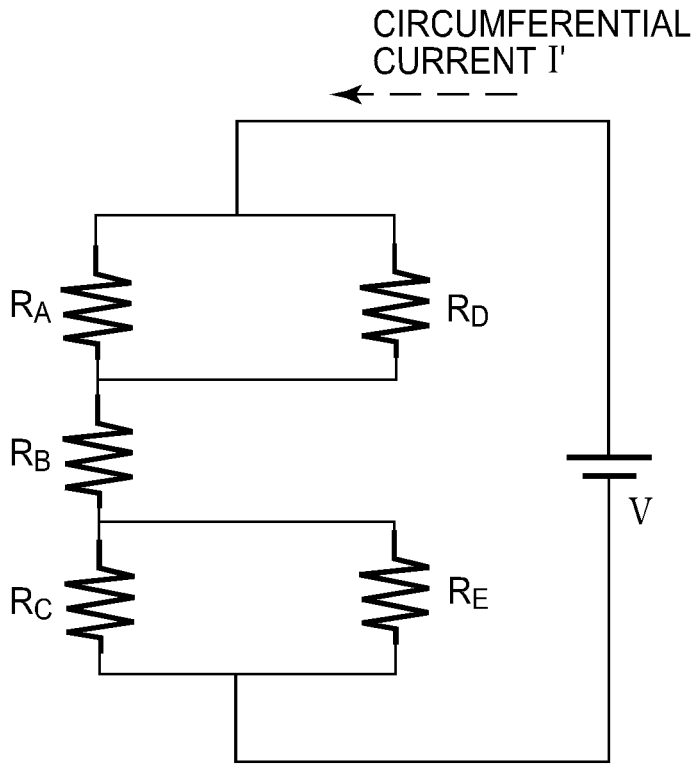

FIG. 10 is a drawing of a circuit equivalent in current flow to the portion of the fixation roller shown in part (a) of FIG. 9.

Figure 11:
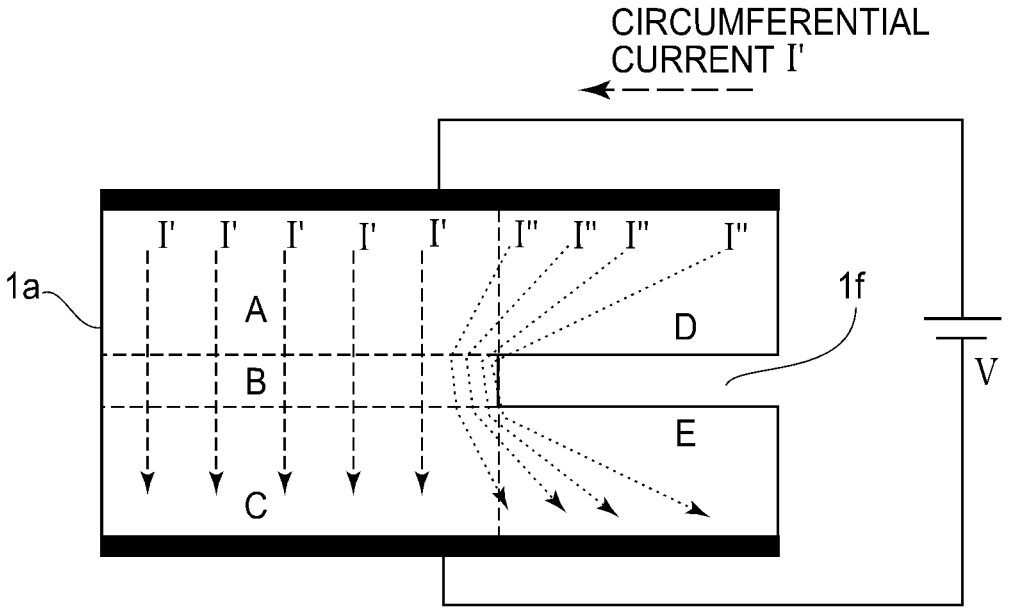

FIG. 11 is a drawing for describing the current that flows in one of the lengthwise end portions of the conductive layer of the fixation roller having a single slot, in the circumferential direction of the fixation roller, in a manner to circumvent the slot.

Figure 12:
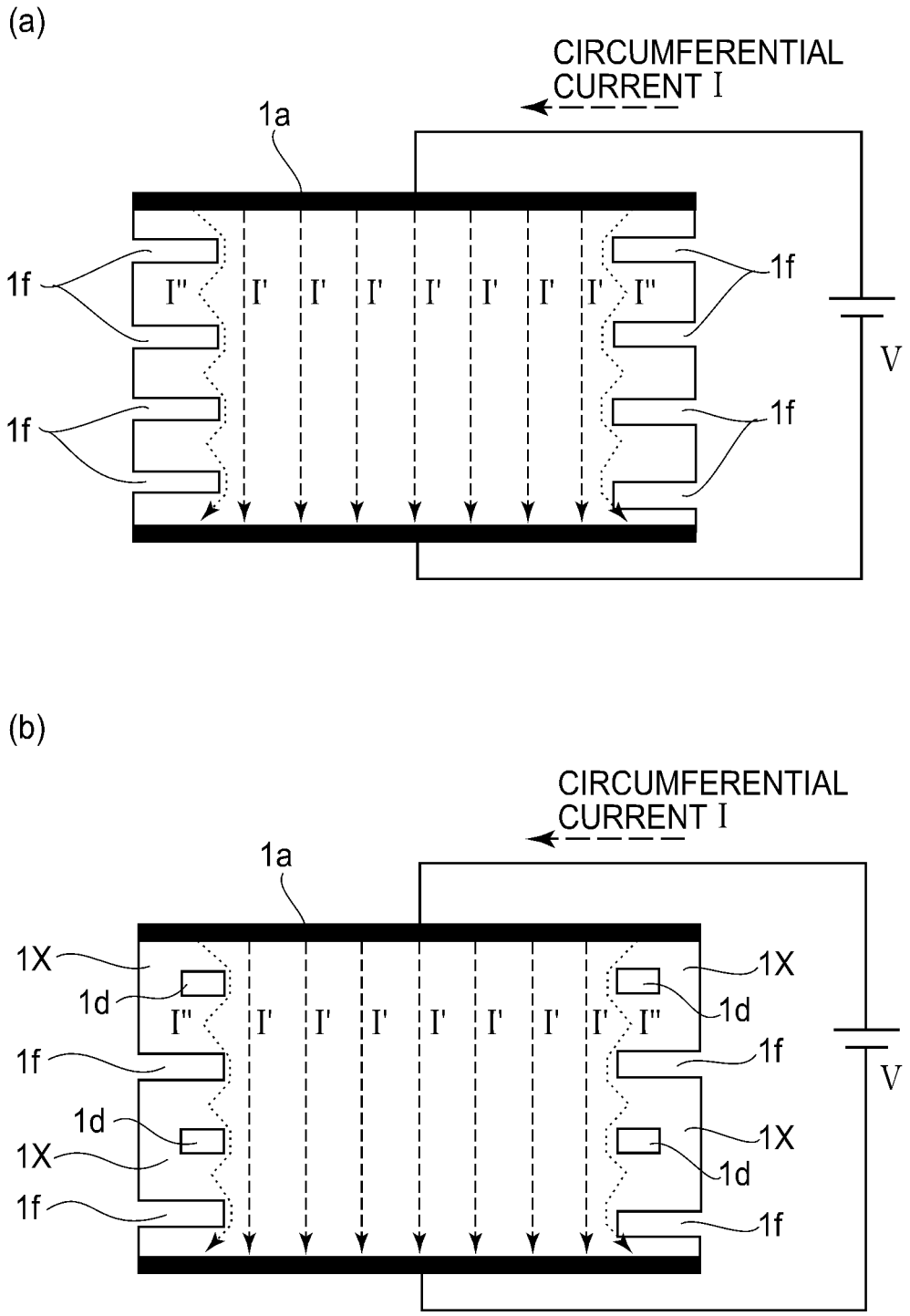

Parts (a) and (b) of FIG. 12 are drawings for describing the current that flows in the lengthwise end portions of a conductive layer of a fixation roller having multiple slots, in the case of part (a), or a combination of multiple slots and holes, in the case of part (b), in a circumferential direction of the fixation roller, in a manner to circumvent each slot and each hole.

Figure 13:
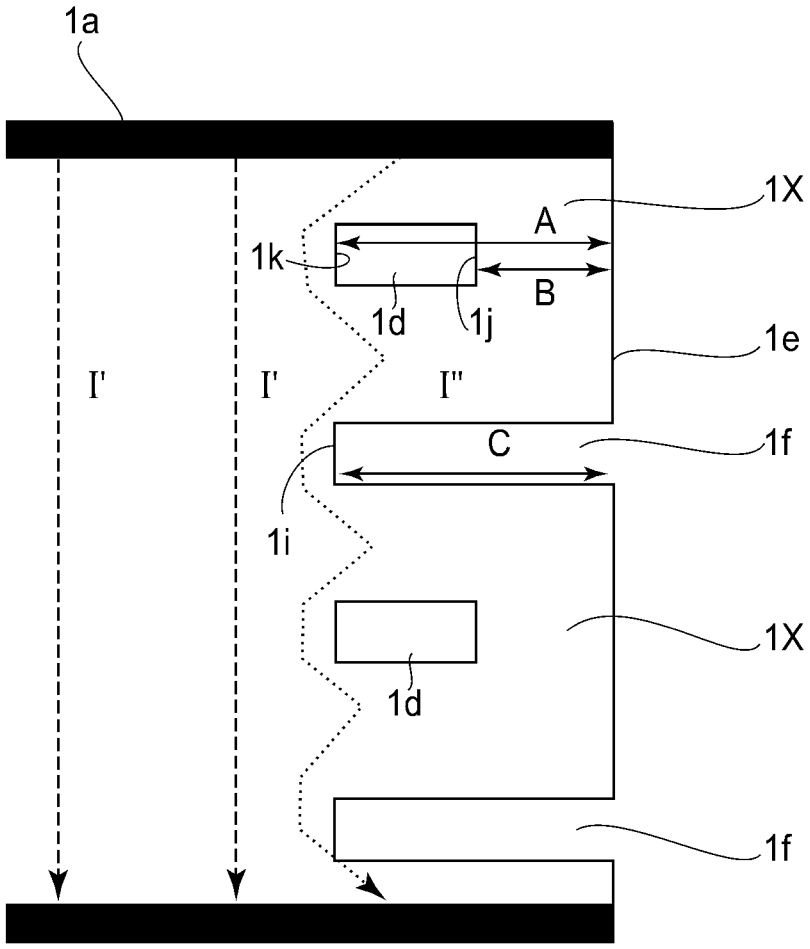

FIG. 13 is drawing for describing a desirable structural design for a development roller, which is for enhancing the effects of the present invention.

Figure 14:
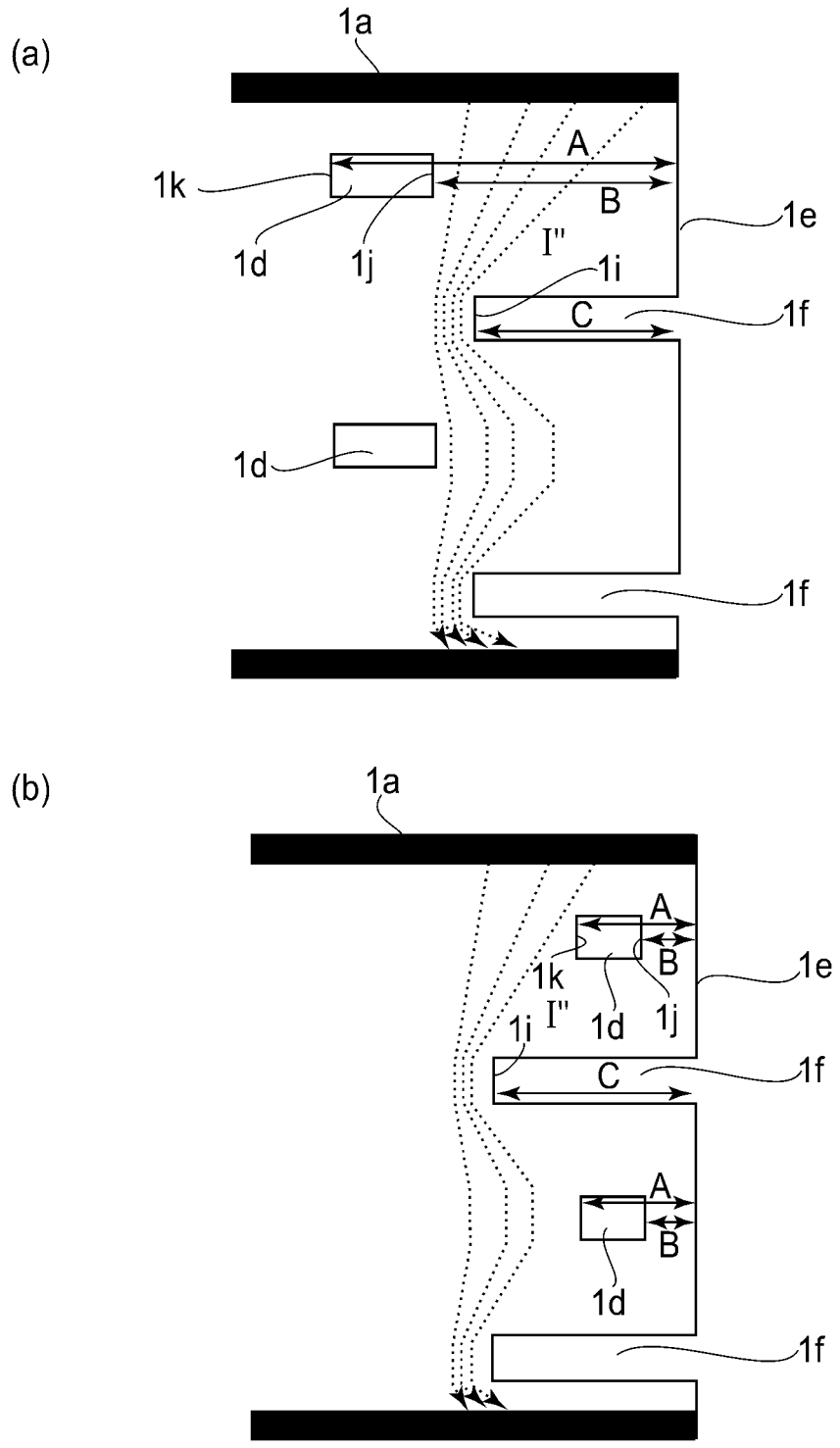

Parts (a) and (b) of FIG. 14 are drawings for describing the current that flows in one of the lengthwise end portions of a conductive layer of a fixation roller having a combination of multiple (two) slots and multiple (two) holes, in the circumferential direction of the fixation roller, in a manner to circumvent the slots and holes.

DESCRIPTION OF THE EMBODIMENTS

Embodiment 1

(1) Example of Image Forming Apparatus

Figure 2:
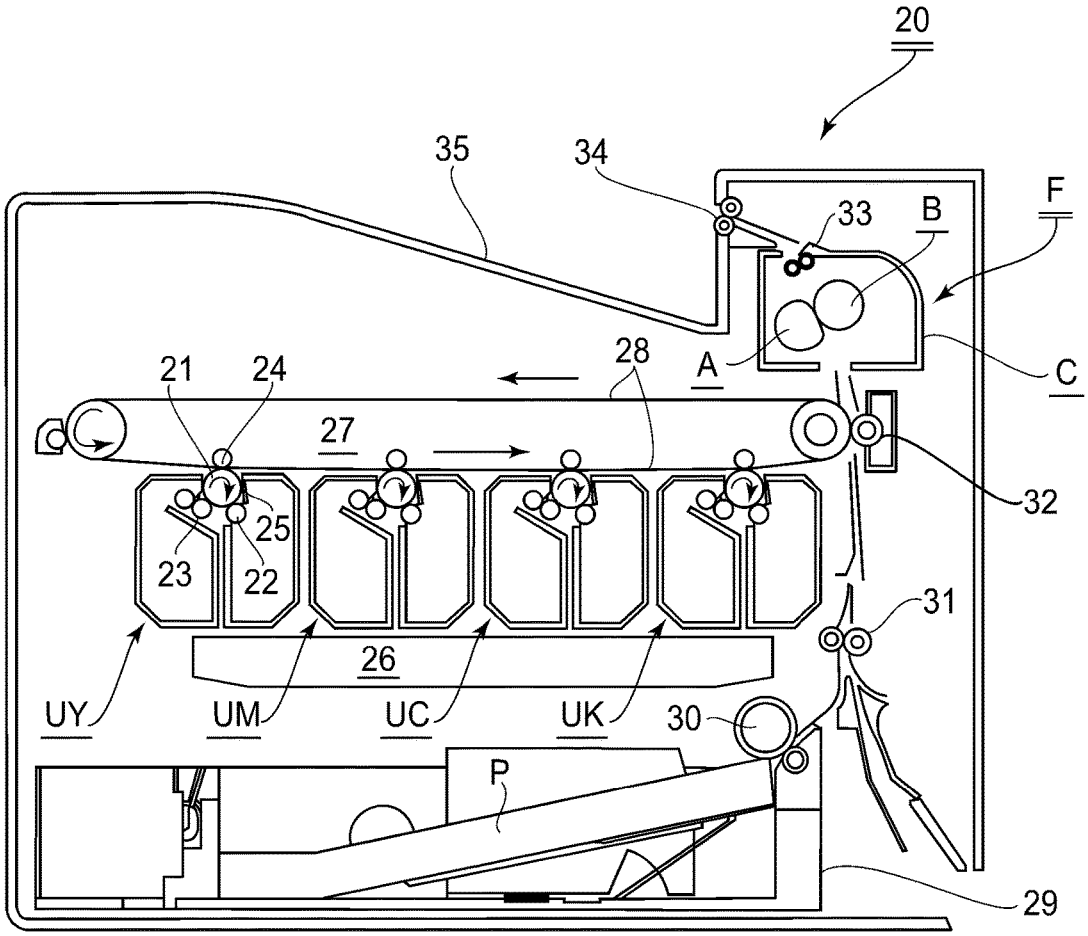
FIG. 2 is a schematic sectional view of an example of an image forming apparatus to which the present invention is applicable, and shows the general structure of the image forming apparatus.

FIG. 2 is a schematic sectional view of an example of image forming apparatus 20 equipped with the fixing device F (fixation unit) in this embodiment of the present invention, and shows the general structure of the image forming apparatus 20. This image forming apparatus 20 is an electrophotographic full-color laser beam printer. Since a printer structure has been widely known, it is not described in detail.

The image forming apparatus 20 has four image formation units U (UY, UM, UC, and UK), a laser scanner unit, and an intermediary transfer belt unit 27. Each image formation unit U has a photosensitive drum 21, a charge roller 22, a developing device 23, a primary transfer roller 24, a cleaning device 25, etc. By the way, from the standpoint of preventing the drawing from appearing excessively complicated, the portions of the image formation units UM, UC, and UK, i.e., the image forming units other than the image formation unit UY, are not provided with a referential code.

As the drum 21 in each image formation unit U is rotated, yellow (Y), magenta (M), cyan (C), and black (K) toner images are formed on the four drums 21 in the four image formation units U, one for one, through an electrophotographic process. Then, from the four drums 21 in the four image formation units U, four toner images, different in color, are sequentially transferred in layers (in a primary transfer operation) onto the endless intermediary transfer belt 28 while the belt 28 is being circularly driven. As a result, an unfixed full-color toner image is effected on the belt 28.

Meanwhile, sheets P of recording medium (recording paper) in a recording medium cassette 29 are fed one by one, into the main assembly of the image forming apparatus 20, by a feed roller 30. Then, each sheet P is conveyed by a pair of registration rollers 31 to a secondary transfer nip, which is the area of contact between the belt 28 and a secondary transfer roller 32, so that the sheet P is introduced into the nip with preset control timing. Thus, the toner images on the belt 28 are transferred (secondary transfer) onto the sheet P.

As the sheet P is comes out of the secondary transfer nip, it is separated from the belt 28, and then, the sheet P is introduced into a fixing device F. While the sheet P is conveyed through the fixing device F, the toner images on the sheet P are fixed to the sheet P by being heated and pressed in the fixing device F. After the fixation of the toner images to the sheet P, the sheet P is conveyed further by a pair of conveyance rollers 33 to a pair of discharge rollers 34. Then, the sheep P is discharged as a full-color print into a delivery tray 35 by the pair of discharge rollers 34.

Fixing Device F

Part (a) of FIG. 3 is a schematic front view of the essential portion of the fixing device F in this embodiment (drawing as seen from recording medium entrance side), and part (b) of FIG. 3 is a vertical sectional view of the essential portion of the fixing device F, at the vertical plane that coincides with the axial line of a fixation roller 1, as seen from the front side of the device F. Part (a) of FIG. 4 is an enlarged schematic sectional view of the essential portion of the fixing device F, at a plane indicated by a pair of arrow marks (4) and (4) in part (a) of FIG. 3. This fixing device F is an image heating device that uses a heating method based on electromagnetic induction. Roughly speaking, the fixing device F has a heating unit A, a pressing unit B, and a boxy shell C (FIG. 2) in which the units A and B are disposed. Part (a) of FIG. 5 is an external perspective view of the heating unit A.

(1) Heating A

The heating unit A has a fixation roller 1, as a rotational heating member (fixing member), which is cylindrical, and the lengthwise direction of which is parallel to the direction parallel to the axis X. The heating unit A also has a roller guiding member 10, a stay 6, and an IH heater unit D as a heating member (heat source), which are disposed in the hollow of the fixation roller 1. Further, the heating unit A has a driving gear 4 (a bevel gear, in this embodiment) attached to one of the lengthwise ends of the fixation roller 1 (an end from which the fixation roller 1 is driven), and a circular roller cap 5 (capping member) attached to the other lengthwise end of the fixation roller 1 (from which fixation roller 1 is not driven).

The driving gear 4 is a driving member for rotationally driving the fixation roller 1. In this embodiment, a combination of the fixation roller 1 and the driving gear 4 attached to at least one of the lengthwise ends of the fixation roller 1 makes up a cylindrical rotational member unit.

Part (b) of FIG. 5 is an external perspective view of the fixation roller 1, and part (b) of FIG. 4 is a schematic drawing for showing the laminar structure of the fixation roller 1. The fixation roller 1 is a cylindrical member, the wall of which is relatively thin. The fixation roller 1 in this embodiment has three layers, more specifically, a cylindrical metallic core 1*a* (electrically conductive layer), an elastic layer 1*b* placed on the peripheral surface of the cylindrical metallic core 1*a*, and a release layer 1*c*, as a surface layer, placed on the outward surface of the elastic layer 1*b*, listing from the inward side of the fixation roller 1.

The metallic core 1*a* is 0.1 mm to 1.0 mm in thickness, and is formed of austenitic stainless steel. As the material for the metallic core 1*a*, a substance having such a specific resistance that can make the metallic core 1*a* generate a sufficient amount of heat based on electromagnetic induction, should be selected. The elastic layer 1*b* is formed of a material, such as silicone rubber that is 20 degrees in hardness (JIS-A, under 1 kg of weight). The elastic layer 1*b* is 0.1 mm to 0.8 mm in thickness. The release layer 1*c* is a piece of fluorine resin tube. The release layer 1*c* covers the elastic layer 1*b*, and is 10 μm to 50 μm in thickness.

Referring to part (b) of FIG. 5, the fixation roller 1 is structured so that the lengthwise end portions of the metallic core 1*a* extend by a preset length beyond the lengthwise ends of the combination of the elastic layer 1*b* and the release (surface) layer 1*c*, one for one. That is, the lengthwise end portions of the metallic core 1*a* extend by the present length from the lengthwise end of the combination of the elastic layer 1*b* and the release (surface) layer 1*c* on the side from which the fixation roller 1 is driven, and on the side from which the fixation roller 1 is not driven. These exposed end portions of the metallic core 1*a* will be referred to as exposed portions 1*g* of the metallic core 1*a*, or simply, exposed portions 1*g*. That is, the elastic layer 1*b* and the release (surface) layer 1*c* are layered in the listed order on the peripheral surface of the metallic core 1*a*, between the pair of exposed portions 1*g* and 1*g*. Referential codes Wa, Wb, and Wc stand for the length of the metallic core 1*a*, length of the elastic layer 1*b*, and the length of release (surface) layer 1*c*, respectively. A referential code WP stands for the dimension (width) of the portion of the fixation roller 1 that corresponds to the path of the widest sheet P of recording medium usable with the fixing device F (image forming apparatus 20), in terms of the lengthwise direction of the fixing device F.

The width WP is narrower by a preset amount than the widths Wb and Wc. Thus, the portions of the fixation roller 1 that are outside the path of a sheet P of recording medium are the out-of-sheet-path portions of the fixation roller 1. Therefore, both the exposed portion 1*g* of the metallic core 1*a* on the side from which the fixation roller 1 is driven, and the exposed portion 1*g* of the metallic core 1*a* on the side from which the fixation roller 1 is not driven are in the out-of-sheet-path portions of the fixation roller 1, one for one.

A roller guide 10 is in the form of a long and narrow trough that is roughly semicircular in cross section. The roller guide 10 is disposed in the hollow of the fixation roller 1 in such an attitude that its lengthwise direction becomes parallel to the axial line of the fixation roller 1, and also, that its outwardly facing surface contacts the inward surface of the fixation roller 1 to guide the fixation roller 1 as the fixation roller 1 is rotated. The guide 10 is required to be heat resistant, low in friction, and low in thermal conductivity. In this embodiment, polyphenyl sulfide (PPS) resin is used as the material for the guide 10. The guide 10 is also disposed in the hollow of the fixation roller 1. Further, the IH heater unit D is also disposed in the hollow of the fixation roller 1, being roughly centered relative to the fixation roller 1 in terms of the radius direction of the fixation roller 1. The guide 10 is supported by the lengthwise end portions of the IH heater unit D, by being fixed thereto by arm portions 10*a* and 10*a*, one for one.

Not only does the guide 10 guide the fixation roller 1 as the fixation roller 1 is rotated, but also, the guide 10 plays the role of backing up the fixation roller 1 as a pressure pad 8 of the pressure unit B (that will be described later) presses on the fixation roller 1. In order to ensure that, as the fixation roller 1 is rotated, it is allowed to smoothly slide on the guide 10, the surface of the guide 10, that contacts the inward surface of the fixation roller 1 is given such curvature as that of the inward surface of the fixation roller 1.

The stay 6 is a long and narrow rigid member that is U-shaped in cross section. The stay 6 is disposed so that its lengthwise direction is parallel to the axis X. The stay 6 is disposed in parallel to the guide 10, and is fixed to the inward side of the guide 10 to support the guide 10. In addition, the stay 6 functions as a member for reinforcing the guide 10.

The IH heater unit D is a heating member for heating the fixation roller 1 based on electromagnetic induction. Part (a) of FIG. 6 is a perspective cutaway view of the heating unit A. It is drawn as if a part of the fixation roller 1 is missing, in order to show a part of the IH heater unit D. The IH heater unit D is equipped with an excitation coil 3, which is disposed in the hollow of the fixation roller 1 in such an attitude that its axis is parallel, or roughly parallel, to the direction that is parallel to the generatrix of the fixation roller 1. The excitation coil 3 has a spirally wound portion. The coil 3 generates an alternating magnetic field that generates heat in the metallic core 1*a*, which is the electrically conductive layer of the fixation roller 1, based on electromagnetic induction. Further, the IH heater unit D has a magnetic core 2, which is disposed on the inward side of the spiral magnetic coil 3, being centrally positioned in terms of the radius direction of the fixation roller 1, to guide the magnetic fluxes of the magnetic field.

The core 2 is in the form of a piece of a circular column. The core 2 also is disposed in the hollow of the fixation roller 1, being roughly centrally positioned by the pair of arm portions 10*a* and 10*a* (part (a) of FIG. 3), which are the lengthwise end portions of the roller guide 10. The core 2 plays the role of forming a magnetic flux passage, which guides the magnetic fluxes of the alternating magnetic field, generated by the coil 3, into the inward side of the metallic core 1*a* (an area between metallic core 1*a* and the core 2). The core 2 is shaped so that it does not form a loop outside the fixation roller 1, and has lengthwise ends.

As the material for the core 2, a substance, such as ferrite made by sintering, and ferrite resin, amorphous metallic alloy, which is small in hysteresis loss and high in relative magnetic permeability, or a ferromagnetic substance, such as Permalloy®, or a similar oxide (that is high in magnetic permeability), is desirable. In particular, in a case in which a high frequency alternating current, that is, an alternating current that is 21 kHz to 100 kHz in frequency, is flowed through the coil 3, ferrite that is made by sintering and is small in loss when the high frequency alternating current is flowed, is desirable.

The core 2 is desired to be as large as possible in cross section, as long as it can be disposed in the hollow of the metallic core 1*a*. In this embodiment, the core 2 is 5 mm to 40 mm in diameter, and 230 mm to 300 mm in length. By the way, it is not mandatory that the core 2 is in the form of a piece of round column, as the core 2 may be in the form of a piece of column that is polygonal in cross section.

The coil 3 is formed by spirally winding copper wire (single wire) that is coated with heat resistant polyamide and 0.5 mm to 2.0 mm in diameter, around the core 2 roughly 10 times to 100 times. In this embodiment, the coil 3 is wound 16 times. The coil 3 is wound in the direction that is intersectional to the axial line of the fixation roller 1. Therefore, as the high frequency alternating current is flowed through the coil 3, an alternating magnetic field that is parallel to the axial line of the fixation roller 1 is generated.

One of the end portions of the core 2 extends outward beyond the circular driving gear 4 that is attached to the lengthwise end of the fixation roller 1 from which the fixation roller 1 is driven. The other end portion of the core 2 extends outward beyond the circular roller cap 5 attached to the other lengthwise end of the fixation roller 1, from which the fixation roller 1 is not driven. The structural arrangement that keeps the driving gear 4 and roller cap 5 attached to the fixation roller 1 is described in detail in Section (4).

The heating unit A is rotatably supported by the boxy shell C of the fixing device F, with the placement of a pair of bearings (unshown) between the lengthwise end of the fixation roller 1, from which the fixation roller 1 is driven, and the corresponding lateral plate (unshown) of the shell C, and between the lengthwise end of the fixation roller 1, from which the fixation roller 1 is not driven, and the corresponding lateral plate (unshown) of the shell C, at the locations 13R and 13F shown in parts (a) and (b) FIG. 3. Further, the lengthwise end portions of the core 2, which are outwardly protrusive from the circular driving gear 4 and the roller cap 5 of the fixation roller 1, are nonrotationally held by the supporting portion (unshown) of the boxy shell C, at the locations 14R and 14F, respectively, as shown in parts (a) and (b) of FIG. 3

(2) Pressure Unit B

The pressure unit B is a nip forming member (opposing member) that forms a nip N (fixation nip) between itself and the fixation roller 1. A sheet P of recording medium is conveyed through the nip N while remaining pinched between the pressure unit B and the fixation roller 1 so that an image T on the sheet P is heated. The pressure unit B in this embodiment has a cylindrical pressure belt 7, which is flexible and the widthwise direction of which is parallel to the axis X. The pressure unit B has also the pressure pad 8 and a rigid stay 9, which are disposed as internal members on the inward side of the cylindrical pressure belt 7. The rigid stay 9 is U-shaped in cross section. These members 8 and 9 also are disposed so that their lengthwise direction is parallel to the axis X. Further, the pressure unit B has a pair of flanges 11R and 11F, which are fitted around the lengthwise end portions of the rigid stay 9, one for one.

The pressure pad 8 is such a member that guides the pressure belt 7 by supporting the pressure belt 7 by the inward surface of the pressure belt 7, and guides the pressure belt 7 as the pressure belt 7 is rotationally driven. The lengthwise end portions of the stay 9 are outwardly protrusive from the lateral edges of the pressure belt 7, one for one. These protrusive end portions of the stay 9 are fitted with a pair of flanges 11R and 11F, one for one. In terms of the lengthwise direction of the fixing device F, the pressure belt 7 is between the flanges 11R and 11F.

The pressure belt 7 may be nonlaminative. In this embodiment, however, a laminar belt formed by placing a release layer 7*b* on one of the surfaces of a substrative layer 7*a*, as shown in part (c) of FIG. 4, which is a drawing for describing the laminar structure of the pressure belt 7, is used. As the material for the substrative layer 7*a*, a resinous substance, such as thermally curable polyimide, a thermoplastic polyimide, a polyamide, polyamideimide, etc., which are heat resistant, is used. As the material for the release layer 7*b*, a substance, such as fluorine resin, or, more specifically, polytetrafluoroethylene (PTFE), a copolymer of tetrafluoroethylene and perfluoro-alkoxylethylene (PFA), and the like, to which toner is unlikely to remain adhered, is used.

The primary role of the pressure pad 8 is to form a nip N by pressing the pressure belt 7 against the fixation roller 1. As the material for the pressure pad 8, a rigid substance, such as metal, and, more specifically, aluminum, stainless steel, steel, copper, brass, etc., their alloys, or resins, which are highly rigid, is primarily used. In this embodiment, a pad formed of a liquid polymer by injection molding and reinforced by glass fiber was used as the pressure pad 8. Therefore, it is ensured that the pressure pad 8 in this embodiment is provided with a proper amount of rigidity in terms of the direction perpendicular to the lengthwise direction of the nip N.

The pressure unit B is disposed in parallel (inclusive of "being roughly parallel") to the fixation roller 1 so that the pressure pad 8 squarely opposes the roller guide 10 of the heating unit A. The flanges 11R and 11F are held to the corresponding lateral plates (unshown) of the boxy shell C of the fixing device F, one for one, so that they are allowed to slide perpendicular to the heating unit A, at the locations 13R and 13F, respectively. Further, the flanges 11R and 11F remain pressed toward the heating unit A by a preset amount of pressure J generated by a pair of pressure application mechanism 12R and 12F located at the lengthwise ends of the pressure unit B, respectively.

Therefore, the pressure pad 8 is pressed against the roller guide 10 of the heating unit A by the preset amount of pressure J, with the pressure belt 7 and the fixation roller 1 being sandwiched between the pressure pad 8 and roller guide 10. Therefore, the fixation nip N, which has a preset dimension in terms of the recording medium conveyance direction a, is formed between the fixation roller 1 and the pressure belt 7.

(3) Fixing Operation

As a driving motor M (driving force source), which is under the control of a control portion 40 (part (a) of FIG. 3), is driven, the driving force from the motor M is transmitted to the driving gear 4 by way of the gears (unshown) of a driving force transmission mechanism, rotating thereby the driving gear 4. Consequently, the fixation roller 1 rotates at a preset peripheral velocity in the counterclockwise direction indicated by an arrow mark RI in part (a) of FIG. 4.

The pressure belt 7 forms the fixation nip N between itself and the fixation roller 1. Therefore, as the fixation roller 1 rotates, the pressure belt 7 is rotated by the rotation of the fixation roller 1 in the clockwise direction indicated by an arrow mark R7. The lateral edges of the pressure belt 7 are in contact with the corresponding flanges 11R and 11F. Therefore, the pressure belt 7 is prevented from deviating in the direction parallel to the axis X as the pressure belt 7 is rotated.

On the other hand, as alternating electrical current is flowed through the coil 3 of the IH heater unit D from the excitation circuit 41 (high frequency convertor) that also is under the control of the control portion 40, the core 2 is magnetized in the direction parallel to the axis X. Consequently, electrical current is induced in the metallic core 1*a* of the fixation roller 1 in such a direction that counters the magnetization of the core 2. The induced current generates heat (Joule's heat) in the metallic core 1*a*. As a result, the fixation roller 1 increases in temperature.

The surface temperature of the fixation roller 1 is detected by a thermistor TH (temperature detection element). Then, the information regarding the detected temperature is fed back to the control portion 40. It is based on this information regarding the detected temperature that the control portion 40 controls the amount by which the electrical power is supplied to the coil 3 from the excitation circuit 41, in such a manner that the surface temperature of the fixation roller 1 is increased to a preset level (fixation temperature) and is kept at the preset level.

As the rotation of the fixation roller 1 stabilizes and the surface temperature of the fixation roller 1 is increased to the preset fixation level, a sheet P of recording medium, on which an unfixed toner image T has just been formed, is introduced into the fixing device F from the image forming portion side of the fixing device F, and is conveyed through the fixation nip N while remaining pinched between the fixation roller 1 and the pressure belt 7. Thus, the unfixed toner image T on the sheet P is fixed, as a permanent image, to the surface of the sheet P by a combination of the heat and the pressure applied to the sheet P and the toner image thereon.

Figure 1:
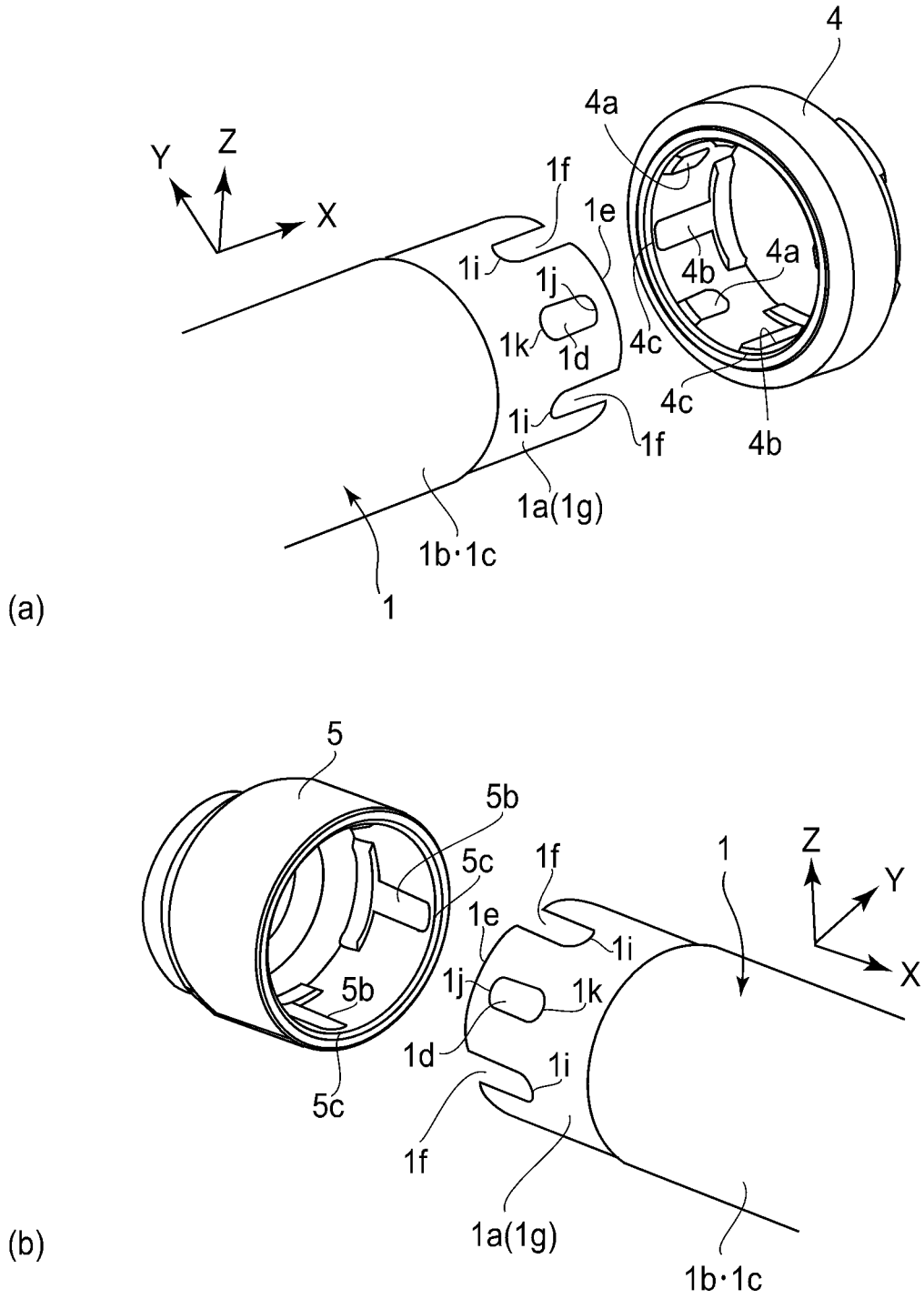

(4) Structural Arrangement for Keeping Driving Gear and Roller Cap Attached to Fixation Roller Part (a) of FIG. 1 is an exploded perspective view of the lengthwise end portion of the fixation roller 1, from which the fixation roller 1 is driven. It shows the lengthwise end portions of the fixation roller 1, and the driving gear 4. Part (b) of FIG. 1 is an exploded perspective view of the lengthwise end portion of the fixation roller 1, from which the fixation roller 1 is not driven, and shows the lengthwise end portion of the fixation roller 1, and the roller cap 5. First, the structural arrangement for keeping the driving gear 4 attached to the lengthwise end portion of the fixation roller 1, from which the fixation roller 1 is driven, is described.

The driving gear 4 has multiple protrusions 4*a*, as engaging portions, that transmit the rotational driving force from the aforementioned motor M to the fixation roller 1, by pressing the fixation roller 1 in the rotational direction of the fixation roller 1, whereas the fixation roller 1 has multiple holes 1*d*, into which the protrusions 4*a* of the driving gear 4 fit to enable the fixation roller 1 to receive the rotational driving force. Further, the fixation roller 1 has multiple slots 1*f*, which extend from the edge 1*e* of the fixation roller 1 toward the center of the fixation roller 1 in terms of the lengthwise direction of the fixation roller 1, by a preset amount. In terms of the circumferential direction of the fixation roller 1, the slots 1*f* are different in position from the holes 1*d*, and the slots 1*f* and the holes 1*d* are alternately positioned.

In this embodiment, it is the exposed portion 1*g* (lengthwise end portion) of the fixation roller 1, from which the fixation roller 1 is driven, that is provided with the holes 1*d* and the slots 1*f*. In terms of the lengthwise direction of the fixation roller 1, the holes 1*d* are between the edge 1*e* of the metallic core 1*a* and the corresponding edge of the elastic layer 1*b*, being roughly evenly distributed in the circumferential direction of the metallic core 1*a*, so that the edges of each hole 1*d*, which are parallel to the lengthwise direction of the hole 1*d*, are parallel to the axial line of the metallic core 1*a* (fixation roller 1). As for the slots 1*f*, which extend toward the center of the fixation roller 1 from the edge 1*e* of the metallic core 1*a*, they also are evenly distributed in terms of the circumferential direction of the metallic core 1*a*, so that the edges of each slot 1*f*, which are parallel to the depth direction of the slot 1*f*, are parallel to the axial line of the fixation roller 1.

In this embodiment, the lengthwise end portion 1*g* of the metallic core 1*a* of the fixation roller 1, from which the fixation roller 1 is driven, and which is outside the path of a sheet P of recording medium, is provided with four holes 1*d*, which are 4.0 mm in width, and four slots 1*f*, which also are 4.0 mm in width (total of eight portions with which the driving gear 4 engages). The eight portions (i.e., the four holes 1*d* and the four slots 1*f*) are roughly evenly distributed in the circumferential direction of the exposed portion 1*g*. Thus, the portions of the metallic core 1*a* that are outside the recording medium path are not contiguous in terms of the circumferential direction, except for the inward edge portions.

Also in this embodiment, the driving gear 4 has ribs 4*b* that fit into the slots 1*f* of the lengthwise end portions of the fixation roller 1 as the metallic core 1*a* is inserted into the driving gear 4. Thus, as the driving gear 4 is rotated, the ribs 4*b* transmit the rotational driving force to the fixation roller 1 by pressing on the fixation roller 1 (i.e., the exposed portion 1*g*).

As described above, the lengthwise end portion of the fixation roller 1, from which the fixation roller 1 is driven, is fitted with the driving gear 4 in such a manner that the protrusions 4*a* engage with the holes 1*d*, one for one, and the ribs 4*b* engage into the slots 1*f*, one for one. Thus, as a driving force is transmitted to the driving gear 4 from an unshown driving force source, the fixation roller 1 rotates.

The driving gear 4 is a bevel gear. Thus, as the driving gear 4 is rotationally driven, a part of the driving force works on the fixation roller 1 in the direction parallel to the axial line of the fixation roller 1. That is, as the driving force is transmitted to the fixation roller 1, the fixation roller 1 is moved in the direction parallel to its axial line.

Next, a description is provided as to how the driving gear 4 is attached, and remains attached, to the fixation roller 1. Referring to part (a) of FIG. 1, the driving gear 4 is provided with a cylindrical hole, which is coaxial with the driving gear 4, and the diameter of which is slightly greater than the external diameter of the metallic core 1*a* of the fixation roller 1. Thus, the exposed portion 1*g* of the metallic core 1*a* of the fixation roller 1, from which the fixation roller 1 is driven, can be inserted into this hole of the driving gear 4. As described above, the inward surface of the driving gear 4, or the surface of this cylindrical hole, is provided with the protrusions 4*a* and the ribs 4*b*, which correspond one for one in position to the holes 1*d* and the slots 1*f* of the exposed portion 1*g* of the metallic core 1*a* of the fixation roller 1.

The method for attaching the driving gear 4 to the fixation roller 1 is as follows. First, the driving gear 4 and the fixation roller 1 are to be positioned so that the protrusions 4*a* and the ribs 4*b* align with the holes 1*d* and the slots 1*f* of the exposed portion 1*g*, one for one, in the direction parallel to the rotational axis of the fixation roller 1. Then, the exposed portion 1*g* of the metallic core 1*a* of the fixation roller 1, from which the fixation roller 1 is driven, is to be inserted into the hole of the driving gear 4, described above, while keeping slightly flexed the portions 1*e* of the exposed portion 1*g*, which are adjacent to the holes 1*d*, toward the axial line of the fixation roller 1. As the holes 1*d* become aligned with the protrusions 4*a*, one for one, in terms of the radius direction of the fixation roller 1, the protrusions 4*a* fit into the holes 1*d*, one for one, allowing thereby the portions 1*e*, which are adjacent to the holes 1*d*, to unbend themselves.

That is, the method for manufacturing the cylindrical rotational member unit having the fixation roller 1, and the driving gear 4 fitted around at least one of the lengthwise end portions of the metallic core 1*a* of the fixation roller 1 to rotate the fixation roller 1, comprises the following steps. That is, the procedure to attach the driving gear 4 to the fixation roller 1 has a step for engaging the protrusions 4*a* into the holes 1*d*, one for one, by inwardly flexing the adjacencies 1*e* of the holes 1*d* of the fixation roller 1, in terms of the radial direction of the fixation roller 1.

The position of the driving gear 4 relative to the fixation roller 1 in terms of the direction in which the driving gear 4 is fitted around the fixation roller 1 (i.e., the direction in which the driving gear 4 is moved toward fixation roller 1 to be fitted around fixation roller 1) is determined by the contact between a leading end 4*c* (part (a) of FIG. 1) of each of the ribs 4*b* of the driving gear 4 and an inward end 1*i* of the corresponding slot 1*f* of the fixation roller 1. As for the position of the driving gear 4 relative to the fixation roller 1 in terms of the opposite direction from the direction in which the driving gear 4 is fitted around the fixation roller 1, it is determined by the contact between each protrusion 4*a* of the driving gear 4 and the outward edge 1*j* (end) of the corresponding hole 1*d* of the fixation roller 1. That is, in terms of the direction in which the driving gear 4 is fitted around the fixation roller 1, each rib 4*b* that engages into the corresponding slot 1*f* extends long enough to come into contact with the inward end of the corresponding slot 1*f*. As for the protrusions 4*a* that engage into the holes 1*d*, each protrusion 4*a* extends in the direction parallel to the axial line of the driving gear 4 so that, as the lengthwise end portion of the fixation roller 1 is inserted into the driving gear 4, an upstream end of the protrusion 4*a*, in terms of the direction in which the driving gear 4 is moved relative to the fixation roller 1, comes into contact with a downstream end 1*k* of the corresponding hole 1*d* of the fixation roller 1.

That is, the multiple protrusions 4*a* and the ribs 4*b*, with which the driving gear 4 is provided, engage into the multiple holes 1*d* and the slots 1*f* of the fixation roller 1, one for one. Therefore, the driving force is transmitted from the driving gear 4 at each of the multiple areas of contact between the fixation roller 1 and the driving gear 4.

Since the fixation roller 1 and the driving gear 4 in this embodiment are structured as described above, the fixing device F in this embodiment is superior to any conventional fixing device in terms of the preciseness of the positional relationship between the fixation roller 1 and the driving gear 4 in terms of the lengthwise direction of the fixation roller 1. Further, it is always at the same position in terms of the direction in which the fixation roller 1 is inserted into the driving gear 4 that the driving force is transmitted from the multiple protrusions 4*a* and the ribs 4*b* of the driving gear 4 to the fixation roller 1. Therefore, the amount of the stress to which the edge of each hole 1*d* of the fixation roller 1 is subjected remains stable, making it unlikely for the lengthwise end portion of the fixation roller 1, from which the fixation roller 1 is driven, to be damaged by the stress.

Table 1 shows the results of tests (simulations) carried out to measure the maximum amount of stress to which the fixation roller 1 is subjected as driving force is transmitted to the fixation roller 1 from the driving gear 4.

More specifically, Table 1 shows the calculated results of an analysis of the simulations (tests), in terms of an elasticity-plasticity analysis, regarding a large amount of deformation/limited slippage.

TABLE 1

| | No. of engaging claws | No. of engaging ribs | Max. stress of roller (MPa) |
|---|---|---|---|
| Comp. Ex. | 0 | 8 | 315 |
| Embodiment | 4 | 4 | 230 |

In the case of an example of a comparative fixing device, the protrusions 4*a* and the holes 1*d* are not provided, and the driving gear 4 is provided with eight ribs 4*b*, whereas the fixation roller 1 of the fixing device F of the preferred embodiment of the invention is provided with eight slots 1*f*, into which the protrusions 4*a* are engaged, one for one.

Referring to Table 1, compared to a comparative example of fixing device, which is structured so that driving force is transmitted to the fixation roller 1 by only the ribs 4*b*, the fixing device F in this embodiment is smaller in the amount of the stress to which the lengthwise end of the fixation roller 1 is subjected. By the way, the results given in Table 1 are those which are obtainable only when the areas of contact between the fixation roller 1 and the driving gear 4 are stable in position in terms of the lengthwise direction of the fixation roller 1. In comparison, the comparative example of fixing device, which relies only on the ribs to transmit the driving force, is unstable in the position of the areas of contact between the ribs of the driving gear 4 and the fixation roller 1 in terms of the lengthwise direction of the fixation roller 1. Therefore, the comparative fixing device is substantially larger in the maximum amount of stress to which the fixation roller 1 is subjected as the driving force is transmitted to the fixation roller 1.

In this embodiment, the fixing device F is structured so that the four holes 1*d* and the four slots 1*f* are evenly distributed in the circumferential direction of the fixation roller 1, and the holes 1*d* and the slots 1*f* are alternately positioned in terms of the circumferential direction of the fixation roller 1, so that the amount of the stress to which the fixation roller 1 is subjected when the driving force is transmitted from the driving gear 4 to the fixation roller 1 is smallest. The best shape for the holes 1*d* and the slots 1*f*, and the positioning of the holes 1*d* and the slots 1*f*, are affected by the material, the size, and the wall thickness of the fixation roller 1. Therefore, the shape and positioning of the holes 1*d* and the slots 1*f* are desired to be determined based on the structure of the fixation roller 1.

In this embodiment, the driving force is transmitted by the multiple protrusions 4*a* and the ribs 4*b* with which the driving gear 4 is provided. This embodiment is not intended to limit the present invention in scope. That is, it is possible that, even if the present invention is applied to fixing devices that have no rib 4*b*, or are different in the number of the protrusions 4*a* and/or the holes 1*d*, results similar to those obtained by this embodiment can be obtained. By the way, in the case of a fixing device that has no rib 4*b*, the slot 1*f* plays a role of making it easier for the adjacencies 1*h* of the hole 1*d* to be inwardly flexed when the protrusions 4*a* of the driving gear 4 are to be engaged into the holes 1*d* of the fixation roller 1, one for one.

Further, in this embodiment, the driving gear 4 was fitted around the fixation roller 1. The present invention is also applicable, however, to a fixing device, the driving gear 4 of which is partially inserted into one of the lengthwise ends of the fixation roller 1, as shown in part (c) of FIG. 6.

Next, referring to part (b) of FIG. 1, the opposite lengthwise end of the fixation roller 1 from the one fitted with the driving gear 4, that is, the lengthwise end portion of the fixation roller 1, from which the fixation roller 1 is not driven, is described. The fixation roller 1 is roughly symmetrical with reference to its lengthwise center. That is, the opposite exposed portion 1*g* of the fixation roller 1 from the one fitted with the driving gear 4, that is, the exposed portion 1*g* of the metallic core 1*a* of the fixation roller 1, which is on the side from the fixation roller 1 that is not driven, is also provided with multiple holes 1*d* and slots 1*f*, like the counterpart on the side from which the fixation roller 1 is driven. This setup is for making the heat distribution of the fixation roller 1 symmetrical with reference to the lengthwise center of the fixation roller 1 as the fixation roller 1 is heated based on electromagnetic induction. This setup can also prevent the out-of-sheet-path portions of the fixation roller 1 from generating heat.

The exposed portion 1*g* of the metallic core 1*a* of the fixation roller 1, which is on the opposite side of the fixation roller 1 from the side from which the fixation roller 1 is driven, is fitted with a roller cap 5 as a capping member. Referring to part (b) of FIG. 1, the fixation roller 1 and the roller cap 5 are structured so that multiple ribs 5*b*, with which the cylindrical internal surface of the roller cap 5 is provided, engage into multiple slots 1*f*, one for one, with which the exposed portion 1*g* of the metallic core 1*a* is provided. The positional relationship between the roller cap 5 and the fixation roller 1 in terms of the direction in which the roller cap 5 is moved relative to the fixation roller 1 to be attached to the fixation roller 1 is determined by the contact between a leading end 5*c* of each rib 5*b* of the roller cap 5, in terms of the direction in which the roller cap 5 is moved to be attached to the fixation roller 1, and a bottom 1*i* of the corresponding slot 1*f* of the fixation roller 1.

By the way, the roller cap 5 is not provided with protrusions that would have engaged with the hole 1*d* of the fixation roller 1. That is, the roller cap 5 is structured so that it is not locked with the fixation roller 1 in terms of the direction in which the roller cap 5 and the fixation roller 1 are moved relative to each other to fit the roller cap 5 around the fixation roller 1, for the following reason. That is, if the driving gear 4 and the roller cap 5 are attached to the fixation roller 1 before the components to be disposed in the hollow of the fixation roller 1 are disposed in the hollow of the fixation roller 1, the space through which these components can be inserted into the fixation roller 1 becomes narrower. A driving force is not directly transmitted to the roller cap 5. Therefore, unlike the driving gear 4, the roller cap 5 is not subjected to a large amount of torque (rotational driving force). Therefore, the roller cap 5 does not cause the fixation roller 1 to be damaged by the stress to which the fixation roller 1 is subjected as the fixation roller 1 is rotated.

(5) Heat Generation Principle (5-1) Shape of Magnetic Field

The primary reason why the fixing device 14 in this embodiment is designed as described above is similar to that disclosed in JP 2000-81806. That is, the spiral excitation coil 3 is disposed within the hollow of the fixation roller 1 in such an attitude that its axial line coincides with that of the fixation roller 1, and the magnetic core 2 is disposed in the hollow of the coil 3 to guide the magnetic field generated by the coil 3. The primary object of this design is to guide the magnetic fluxes (magnetic field) generated by the magnetic field generating means, in such a manner that the magnetic fluxes do not infringe into the conductive layer 1*a* of the fixation roller 1 (cylindrical member).

If it is assumed here that the fixing device F is a magnetic circuit, the objective of this embodiment (present invention) is to make the magnetic resistance of the fixation roller 1, in terms of the lengthwise direction of the fixation roller 1, which is an index for showing degree of easiness at which magnetism is allowed to move through the fixation roller 1, sufficiently small, and also, to make the conductive layer 1*a* of the fixation roller 1 sufficiently large in the magnetic resistance on the inward side of the conductive layer 1*a* in terms of the lengthwise direction of the fixation roller 1.

As such "state" is realized, magnetic fluxes are concentrated into the core 2, and therefore, it is possible to prevent magnetic fluxes from being present in the conductive layer 1*a* of the fixation roller 1 and on the inward side of the conductive layer 1*a*. The conductive layer 1*a* of the fixation roller 1 is subjected to such electromagnetic force that induces in the conductive layer 1*a*, such electric current that flows in the circumferential direction of the conductive layer 1*a*. This current can efficiently generate heat (Joule's heat) in the conductive layer 1*a*. Unlike a conventional method such as the one disclosed in JP 2014-26267, the method in this embodiment does not require for magnetic fluxes to be guided into the conductive layer 1*a* of the fixation roller 1. Therefore, the method in this embodiment is meritorious in that it is less restricted regarding the thickness and material of the conductive layer 1*a* than any conventional one.

(5-2) Principle Based on which Heat is Generated in Slot-Less Conductive Layer of Fixation Roller.

Next, the principle based on heat is generated in the conductive layer 1*a* in this embodiment is described in comparison to the principle based on which heat is generated in the slot-less conductive layer 1*a* of the fixation roller 1.

Referring to part (a) of FIG. 7, the heat generation mechanism of the fixing device F in this embodiment is described. As alternating current is flowed through the coil 3, a magnetic field is generated so that its magnetic fluxes transmit through the core 2, which is on the cylindrical conductive layer 1*a*, in the direction (S-to-N direction), which is parallel to the axial line of the conductive layer 1*a*. As the magnetic fluxes come out of one end (N) of the lengthwise ends of the core 2, they return to the other end (S).

As the alternating magnetic fluxes transmit through the conductive layer 1*a* in the direction parallel to the axial line of the conductive layer 1*a*, electrical current is induced in the conductive layer 1*a* in the circumferential direction of the conductive layer 1*a*, in a manner to counter the fluctuation of the magnetic fluxes generated by the current flowed through the coil 3. This current generates heat (Joule's heat) in the conductive layer 1*a*. The amount V by which current is induced in the conductive layer 1*a* is proportional to the amount ($\Delta\phi/\Delta t$) by which the magnetic fluxes fluctuate per unit length of time while it transmits through the conductive layer 1*a*, and the number N of times the coil 3 is wound around the core 2, as expressed by the following Equation (1):

$$V = -N\frac{\Delta\Phi}{\Delta t}. \tag{1}$$

By the way, the core 2 shown in part (a) of FIG. 7 is not shaped to form a loop. Rather, it is in the form of a piece of a straight round rod, having two lengthwise ends. In the case of a fixing device F having a core 2 that forms a loop, as shown in part (b) of FIG. 7, that extends from one end of the cylindrical conductive layer 1*a* to the other end through the inward side of the cylindrical conductive layer 1*a*, and then loops back to the first end, on the outward side of the cylindrical conductive layer 1*a*, the magnetic fluxes are guided out of the inward side of the cylindrical conductive layer 1*a* by the core 2, and then are guided back into the inward side of the conductive layer 1*a* by the outward portion of the core 2, which forms a loop.

In the case of a fixing device F having a core 2 that is in the form of a straight piece of rod having lengthwise ends, as shown in part (a) of FIG. 7, however, there is nothing that guides the magnetic fluxes as they come out of one of the lengthwise ends of the core 2. Therefore, it is possible that, as the magnetic fluxes come out of one of the lengthwise ends of the core 2, they may take the external route, that is, a route that is outside the cylindrical conductive layer 1*a*, as well as the internal route, that is, a route that is within the hollow of the cylindrical conductive layer 1*a*. Hereafter, the magnetic flux route that extends from one end N of the core 2 to the other end S of the core 2 on the outward side of the cylindrical conductive layer 1*a* is referred to as "outside route", whereas the magnetic flux route that extends from the end N of the core 2 to the other end S of the core 2, on the inward side of the cylindrical conductive layer 1*a*, is referred to as "inside route".

There is a correlation between the ratio of the magnetic fluxes that take the outside route, relative to the entirety of the magnetic fluxes that come out of one of the lengthwise ends of the core 2, and the amount (i.e., the electrical power conversion efficiency) by which the electrical power inputted into the coil 3 is consumed for the heat generation in the conductive layer 1*a*. Thus, the amount by which the electrical power inputted into the coil 3 is consumed for the heat generation is a very important parameter.

The greater the ratio of the magnetic fluxes that take the outside route, the greater the ratio with which the electrical power inputted into the coil 3 is consumed for the heat generation in the conductive layer 1*a* (i.e., the greater the power conversion efficiency). The reason for the occurrence of this phenomenon is the same in principle as the phenomenon that, provided that a transformer is negligibly small in magnetic flux leakage, the transformer is greater in power conversion efficiency if the number of magnetic fluxes that pass through the primary coil of the transformer is equal to the number of magnetic fluxes that pass through the secondary coil.

That is, in the case of this embodiment, the closer the number of magnetic fluxes that pass through the core 2 to the number of magnetic fluxes that takes the outside route, the greater the fixation roller 1 in power conversion efficiency. That is, the high frequency current that is flowed through the coil 3 can be efficiently converted into such a current that flows through the conductive layer 1*a* in the circumferential direction of the conductive layer 1*a*, for the following reason.

That is, referring to part (a) of FIG. 7, the magnetic fluxes that pass through the core 2 are opposite in direction from the magnetic fluxes that take the inside route. Thus, if the number of the magnetic fluxes on the inward side, inclusive of the magnetic core 2, of the cylindrical conductive layer 1*a* is the same as the number of the magnetic fluxes on the outward side of the cylindrical conductive layer 1*a*, these magnetic fluxes cancel each other out. Thus, the number of magnetic fluxes that pass through the entirety of the inward side of the conductive layer 1*a* is reduced, and, therefore, the changes that occur to the magnetic field per unit length of time reduces. As the magnetic field reduces in the amount of change per unit length of time, the amount by which current is induced in the conductive layer 1*a* reduces, which results in a reduction in the amount by which heat is generated in the conductive layer 1*a*.

As described above, from the standpoint of improving the fixing device F in power conversion efficiency, it is important that the fixing device F is controlled in the ratio of the magnetic fluxes that take the outside route.

(5-3) Equivalent Circuit to Conductive Layer of Cylindrical Rotational Member

Part (a) of FIG. 8 is a perspective view of the conductive layer 1*a* of the slot-less fixation roller 1. As the conductive layer 1*a* is subjected to a power generating force that works in the circumferential direction of the conductive layer 1*a*, a current I flows in the conductive layer 1*a* in the direction indicated by the arrow marks. Part (b) of FIG. 8 is a circuit that is equivalent to a circuit created by flattening the cylindrical conductive layer 1*a* by cutting the cylindrical conductive layer 1*a* in a direction parallel to the axial line of the conductive layer 1*a*, and applying a DC voltage between the two edges. In this case, an overall amount of resistance R of the conductive layer 1*a* can be expressed in the form of the following Equation (2), in which L, θ, d, and p stand for the length of the conductive layer 1*a* in terms of the direction parallel to the generatrix of the conductive layer 1*a*, the circumference of the conductive layer 1*a*, the thickness of the conductive layer 1*a*, and the electrical resistivity of the conductive layer 1*a*, respectively:

$$R = \frac{\theta}{Ld}\rho. \tag{2}$$

Therefore, if the conductive layer 1*a* in part (b) of FIG. 8 is subjected to the power generating force V, the overall amount W by which heat is generated in the conductive layer 1*a*, and the amount ω by which heat is generated in conductive layer 1*a* per unit volume of the conductive layer 1*a*, can be calculated by the following Equations (3) and (4), respectively:

$$W = \frac{v^2}{R} = \frac{Ld}{\theta}\frac{v^2}{\rho}, \tag{3}$$

$$\omega = \frac{W}{\theta Ld} = \frac{1}{\theta^2}\frac{v^2}{\rho}. \tag{4}$$

Next, the principle based on which heat is generated in the conductive layer 1*a* of the fixation roller 1, which has slots 1*f*, is described.

(5-4) Principle Based on which Slots Prevent Heat from Excessively Generating in the Conductive Layer 1*a*

Next, regarding a fixing device, like the one in this embodiment, the fixation roller 1 of which is heated by the heat generated therein by the current that flows through its conductive layer 1*a* in the circumferential direction of the fixation roller 1, the principle based on which the distribution of slots across the lengthwise end portions of the fixation roller 1 in terms of the circumferential direction of the fixation roller 1 prevents the lengthwise end portions from being excessively heated, is described with the use of the calculation made with reference to an electrical circuit equivalent to the fixation roller 1, by comparing a fixation roller, the cylindrical conductive layer 1*a* of which has slots and a fixation roller, the cylindrical conductive layer 1*a* of which does not have slots.

Part (a) of FIG. 9 is a schematic perspective view of a cylindrical conductive layer 1*a* of the fixation roller 1, shown in FIG. 1, that has only one slot 1*f*. As the conductive layer 1*a*, structured as shown in part (a) of FIG. 9, is subjected to the power generating force V that works in the circumferential direction of the conductive layer 1*a*, a current I' flows through the conductive layer 1*a* in the direction indicated by arrow marks in part (a) of FIG. 9. Part (b) of FIG. 9 is a drawing of an electrical circuit that is equivalent to the circuit made by flattening the cylindrical rotational member 1*a* by cutting the rotational member 1*a* in the direction parallel to the axial line of the rotational member 1*a* and attaching a power generating means to the flattened rotational member so that DC voltage is applied between the two edges of the flattened rotational member that are parallel to the rotational axis of the rotational member 1*a*.

Referring to part (b) of FIG. 9, "a" stands for the dimension (depth) of the slot 1*f* in terms of the direction parallel to the axial line of the cylindrical rotational member 1*a*, and "b" stands for the dimension (width) of the slot 1*f* in terms of the circumferential direction of the cylindrical rotational member 1*a*. It is reasonable to suppose that the flattened cylindrical member 1*a* comprises five zones (areas) A to E. If it is assumed here that the five zones A to E have electrical resistances RA to RE, respectively, and also, that it is only the current that flows through the conductive layer 1*a* in the circumferential direction of the conductive layer 1*a* that contributes to the heat generation in the conductive layer 1*a*, part (b) of FIG. 9 can be approximately redrawn as the electrical circuit shown in FIG. 10. The overall amount R' of electrical resistance of the conductive layer 1*a* in FIG. 10 is expressible if the form of Equation (5):

$$R' = \frac{R_A R_D}{R_A + R_D} + R_B + \frac{R_C R_B}{R_C + R_B}. \tag{5}$$

In the case of the conductive layer 1*a* shown in part (a) of FIG. 9, there is only one slot 1*f*. Therefore, if it is assumed here that the slot 1*f* is at the center of the fixation roller 1 in terms of the circumferential direction of the fixation roller 1, there are following relationships among electrical resistances $R_A$ to $R_E$ and the aforementioned parameters:

$$R_A = R_C = \frac{\theta - b}{2(L-a)d}\rho, \tag{6}$$

$$R_B = \frac{b}{(L-a)d}\rho, \text{ and} \tag{7}$$

$$R_D = R_E = \frac{\theta - b}{2ad}\rho. \tag{8}$$

By substituting RA to RE in Equation (5) with Equations (6) to (8), R' can be simplified as Equation (9):

$$R' = \frac{(L-a)\theta + ab}{(L-a)Ld}\rho. \tag{9}$$

Therefore, the amount by which heat is generated by the overall amount R' of electrical resistance in FIG. 10, that is, the overall amount W by which heat is generated in the conductive layer 1*a* as the conductive layer 1*a* in part (b) of FIG. 9 is subjected to the power generating force V, is expressed in the form of Equation (10):

$$W' = \frac{v^2}{R'} = \frac{(L-a)Ld}{(L-a)\theta + ab}\frac{v^2}{\rho}. \tag{10}$$

There is the following relationship, expressible in the form of Expression (11), between the amount W' (Equation (10)) by which heat is generated in the conductive layer 1*a* having the slot 1*f* and the amount W (Equation (3)) by which heat is generated in the conductive layer 1*a* having no slot, provided that both conductive layers 1*a* are subjected to the same amount of power generating force V:

$$\frac{W'}{W} = \frac{(L-a)\theta}{(L-a)\theta + ab} < 1 \quad (\because ab > 0). \tag{11}$$

Based on Expression (11), W'<W. Thus, it is proven that the presence of the slot 1*f* can prevent the generation of an unnecessary amount of heat.

(5-5) Principle Regarding why Adjacencies of a Slot are Greater in the Amount of Heat Generation In the case of an electrical circuit, such as the one shown in part (b) of FIG. 9, the presence of the slot 1*f* reduces the overall amount by which heat is generated in the conductive layer 1*a*. On the other hand, the presence of the slot 1*f* causes the current generated in the zones D and E to circumvent the slot 1*f*. That is, the presence of the slot 1*f* generates a current I" that flows through the right end portion of the zone B. Therefore, the right end portion of the zone B increases in the amount of current, and, therefore, increases in the amount by which heat is generated therein. If the amount by which heat is generated in the right end portion of the zone B becomes substantial, it will possibly lead to such problems as the damage to the fixation roller 1, and, in particular, the key portions of the fixation roller 1.

(6) Method that Relies on Shape and Positioning of Slot to Prevent Adjacencies of Inward End of Slot from Generating Heat Referring to part (a) of FIG. 12, cutting multiple slots 1*f* in the lengthwise end portions of the conductive layer 1*a*, in such a pattern that the holes 1*f* are distributed in the circumferential direction of the conductive layer 1*a*, can effectively reduce the amount by which the current I" is generated in a manner to circumvent (detour around) the slots 1*f*. Therefore, cutting multiple slots 1*f* can prevent the problem that the fixation roller 1 is damaged by the large amount of heat generated by the large amount of current generated in the adjacencies of the inward end of the slots 1*f*.

The greater the number of slots 1*f*, the more effectively the current I" is prevented from being generated in a manner to detour through the adjacencies of the inward end of each slot 1*f*. The greater the number of slots 1*f*, however, the weaker the lengthwise end portions of the fixation roller 1. Besides, as a rotational force is transmitted from the driving gear 4 to one of the lengthwise ends of the fixation roller 1, this force works in a manner to widen the slots 1*f*. Therefore, increasing the lengthwise end portions of the fixation roller 1 in the number of slots 1*f* is problematic in that the greater the number of slots 1*f*, the weaker the lengthwise end portions of the fixation roller 1, and, therefore, the more likely it is for the fixation roller 1 to be damaged by the driving force from the driving gear 4.

(6-1) Method for Preventing a Problem in which the Lengthwise End Portions of the Fixation Roller are Weakened by the Presence of Slots Referring to part (b) of FIG. 12, one of the methods for preventing the problem described above is to provide the lengthwise end portions of the fixation roller 1 with a combination of multiple slots 1*f*, the long edges of which are parallel to the axial line of the fixation roller 1, and multiple elongated holes, the long edges of which are parallel to the lengthwise direction of the fixation roller 1, and to position the slots 1*f* and the holes 1*d* so that they are alternately and evenly distributed in the circumferential direction of the fixation roller 1.

With the fixation roller 1 being structured as described above, it is possible to effectively prevent the occurrence of the "detouring current", while minimizing the amount by which the fixation roller 1 is reduced in strength by the structural arrangement for the prevention of the occurrence of the "circumventive (detouring) current". From the standpoint of reducing the occurrence of the "circumventive (detouring) current", this structural arrangement is as effective as eight slots 1*f*. That is, in the case of this structural arrangement, a portion X1 makes the upstream and downstream sides of the corresponding hole 1*d* contiguous, in terms of the rotational direction of the fixation roller 1. Thus, it is meritorious in that it provides the lengthwise end portions of the fixation roller 1 with a sufficient amount of mechanical strength.

Further, as described above, this structural arrangement can improve the fixing device F in accuracy in terms of the positional relationship between the fixation roller 1 and the driving gear 4 in terms of the lengthwise direction of the fixation roller 1. Therefore, it can ensure that, in terms of the direction in which the protrusions 4*a* and the ribs 4*b* of the driving gear 4 are inserted into the holes 1*d* and the slots 1*f* of the fixation roller 1, respectively, the position at which the driving force is transmitted from the driving gear 4 to the fixation roller 1 always remains the same. Therefore, the amount of the stress, to which the edge of each hole 1*d* of the fixation roller 1 is subjected, remains stable. Therefore, this structural arrangement can prevent the fixation roller 1 from being damaged by the stress.

Referring to FIG. 13, from the standpoint of ensuring that this structural arrangement is effective, the length A from the lengthwise end 1*e* of the fixation roller 1 to the farthest end 1*k* of the hole 1*d* from the lengthwise end 1*e*, and the length B from the lengthwise end 1*e* of the fixation roller 1 to the closest end 1*j* of the hole 1*d* to the lengthwise end 1*e*, and the length C from the lengthwise end 1*e* of the fixation roller 1 to the farthest edge 1*i* of the slot 1*f* from the lengthwise end 1*e*, satisfy the following relationship: $A \geq C > B$.

Referring to part (a) of FIG. 14, if $B > C$, it is impossible to prevent current from flowing (detouring) as indicated by dotted lines. On the other hand, referring to part (b) of FIG. 14, if $C > A > B$, it is impossible to prevent current from flowing (detouring) as indicated by dotted lines. This is why it is desired that A, B, and C satisfy at least $(A \geq C > B)$.

Therefore, in this embodiment, the fixing device F is structured so that the multiple holes 1*d* and the slots 1*f* are positioned in each of the areas of the lengthwise end portions of the fixation roller 1, which is outside the sheet path in terms of the lengthwise direction of the fixation roller 1. Further, the fixing device F is structured so that, while the fixation roller 1 is rotationally driven by the driving gear 4, which is a bevel gear, the fixation roller 1 remains pressed toward the driving gear 4. Therefore, the fixing device F remains stable in the positional relationship among the fixation roller 1, the core 2, and the coil 3 in terms of the lengthwise direction of the fixing device F. Therefore, the out-of-sheet-path portions of the lengthwise end portions of the fixation roller 1 remain uniform in temperature. That is, this embodiment (present invention) can simplify the means for preventing the out-of-sheet path portions of the fixation roller 1 from becoming excessively high in temperature and/or nonuniform in temperature.

Therefore, even if a piece of metallic cylinder, which is thin, and, therefore, is small in thermal capacity, is used as the conductive layer for a fixation roller, it is possible to realize such a fixation roller that, the lengthwise end portions of which are shaped so that they are not damaged by a large amount of rotational torque, and, therefore, it is possible to provide an image forming apparatus that requires a significantly shorter length of time to warm up, and smaller in power consumption than any conventional image forming apparatus.

The following is a summary of the effects of this embodiment when the fixation roller 1*a* is used in a fixing device as the cylindrical rotational member.

(1) Even if the cylindrical rotational member is subjected to a large amount of torque, the stress generated in one of the lengthwise end portions of the cylindrical rotational member is evenly dispersed. Therefore, the cylindrical rotational member is unlikely to be damaged by the torque.

(2) It is possible to reduce the cylindrical rotational member in thickness to reduce it in thermal capacity, in order to reduce an image forming apparatus in the length of warm-up time and power consumption.

(3) It is possible to minimize the amount by which heat is generated in the out-of-sheet-path portions of the cylindrical rotational member of a fixing device having a spiral excitation coil, and a magnetic core put through the excitation coil.

(4) It is possible to prevent the problem that the portions of the lengthwise end portions of the cylindrical rotational member, which are adjacent to the inward end of each slot, are excessively heated by the current that circumvents (detours around) the inward end of the slot, by differently shaping the lengthwise end portions of the fixation roller from a conventional one.

(5) It is possible to prevent the key portions of the fixation roller, which correspond to the protrusions (ribs) of the driving gear, from being damaged by the heat generated in the out-of-sheet-path portions of the fixation roller, and, in particular, the heat generated in the adjacencies of the inward end of each slot of the conductive layer of the fixation roller, by the current that circumvents (detours around) the inward end of the slot, that is, the current that flows through the adjacencies of the inward end of the slot.

MISCELLANIES (1) The choice of the heating member (heat source) for heating the fixation roller 1 does not need to be limited to the IH heater unit, such as the one in this embodiment. Other heaters different than the one used in this embodiment may be used according to the intended usage for the heating member. For example, a halogen heater may be used. It is not mandatory that a fixing device is structured so that its fixation roller is internally heated, and a fixing device may be structured so that its fixation roller is externally heated.

(2) The pressure application unit B as a nip forming member may be an elastic pressure roller.

(3) Usage of the fixing device F does not need to be limited to heating an unfixed toner image formed on a sheet of recording medium, in order to fix the image to the sheet. For example, the fixing device F is also effective as a device for reheating and repressing a permanently or temporarily fixed image on a sheet of recording medium, in order to alter the image in surface properties, for example, to improve the image in glossiness (device used for these purposes is also referred to as fixing device).

(4) The cylindrical rotational member in the embodiment of the present invention was the fixation roller 1 fitted with the driving gear 4 as a driving member. The application of the present invention is not limited, however, to the fixation roller 1. That is, the present invention is applicable to all of cylindrical rotational members having a thin wall.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device for fixing an image on a recording material, said fixing device comprising:

a cylindrical rotatable heating member, said rotatable heating member being provided with a hole portion at least at a longitudinal end portion; and a driving member engaged with the longitudinal end portion of said rotatable heating member to rotate said rotatable heating member, said driving member being provided with a claw portion engaged with the hole portion of said rotatable heating member, wherein the image is fixed on the recording material by the heat from said rotatable heating member, and wherein said rotatable heating member is provided, at the longitudinal end portion, with a slit extending toward a central portion, the slit being disposed at a position different from the hole portion with respect to a circumferential direction of said rotatable heating member so as to overlap the hole portion in the longitudinal direction of said rotatable heating member.

2. The fixing device according to claim 1, wherein a plurality of such hole portions and a plurality of such slits are provided, and are arranged in the circumferential direction of said rotatable heating member.

3. The fixing device according to claim 2, wherein the plurality of hole portions and the plurality of slits are provided alternately in the circumferential direction of said rotatable heating member.

4. The fixing device according to claim 1, wherein a distance A, measured in the longitudinal direction, from a longitudinal end of said rotatable heating member to one end of the hole portion more remote from the longitudinal end of said rotatable heating member, a distance B, measured in the longitudinal direction, from the longitudinal end of the rotatable heating member to an end of the hole portion closer to the longitudinal end of said rotatable heating member, and a length C of the slit, satisfy $A \geq C > B$.

5. The fixing device according to claim 1, wherein said driving member is provided with a rib engaged with the slit.

6. The fixing device according to claim 1, wherein a position of said driving member relative to said rotatable heating member in a direction away from said rotatable heating member along the longitudinal direction of said rotatable heating member is determined by the claw portion of said driving member contacting an end of the hole portion more remote from a longitudinal central portion of said rotatable heating member.

7. The fixing device according to claim 5, wherein a position of said driving member relative to said rotatable heating member in a direction toward said rotatable heating member along the longitudinal direction of said rotatable heating member is determined by an end portion of the rib closer to a center portion of said rotatable heating member contacting an end of the slit closer to a longitudinal central portion of said rotatable heating member, and a position of said driving member relative to said rotatable heating member in a direction away from said rotatable heating member along the longitudinal direction of said rotatable heating member is determined by the claw portion of said driving member contacting an end of the hole portion more remote from the longitudinal central portion of said rotatable heating member.

8. The fixing device according to claim 1, further comprising:

a coil provided inside of said rotatable heating member, said coil including a helical configuration portion having a helicity axis extending along the longitudinal direction of said rotatable heating member; and a magnetic core provided in the helical configuration portion of said coil.

9. The fixing device according to claim 8, wherein said magnetic core includes an end portion so as not to form a loop outside of said rotatable heating member.

10. A fixing device for fixing an image on a recording material, said fixing device comprising:

a cylindrical rotatable heating member, said rotatable heating member being provided with a hole portion at least at a longitudinal end portion; and a driving gear engaged with the longitudinal end portion of said rotatable heating member, said driving gear including a gear portion at an outer circumference thereof and a claw portion at an inner circumference opposed thereto, the claw portion being engaged with the hole portion of said rotatable heating member, wherein the image is fixed on the recording material by the heat from said rotatable heating member, and wherein said rotatable heating member is provided, at the longitudinal end portion, with a slit extending toward a central portion of said rotatable heating member in the longitudinal direction of said rotatable heating member, the slit being disposed at a position different from the hole portion with respect to a circumferential direction of said rotatable heating member, so as to overlap the hole portion in the longitudinal direction of said rotatable heating member.

11. The fixing device according to claim 10, wherein a plurality of such hole portions and a plurality of such slits are provided and are arranged in the circumferential direction of said rotatable heating member, and wherein the plurality of hole portions and the plurality of slits are provided alternately in the circumferential direction of said rotatable heating member.

12. The fixing device according to claim 11, wherein a distance A, measured in the longitudinal direction, from a longitudinal end of said rotatable heating member to one end of each of the plurality of hole portions more remote from the longitudinal end of said rotatable heating member, a distance B, measured in the longitudinal direction, from the longitudinal end of said rotatable heating member to an end of each of the plurality of hole portions is closer to the longitudinal end of said rotatable heating member, and a length C of each of the plurality of slits, satisfy $A \geq C > B$.

13. The fixing device according to claim 10, wherein said driving gear is provided at the inner circumference with a rib engaged with the slit.

14. The fixing device according to claim 10, further comprising:

a coil provided inside of said rotatable heating member, said coil including a helical configuration portion having a helicity axis extending along the longitudinal direction of said rotatable heating member; and a magnetic core provided in the helical configuration portion of said coil.

15. The fixing device according to claim 14, wherein said magnetic core includes an end portion so as not to form a loop outside of said rotatable heating member.

* * * * *